US009781539B2

(12) United States Patent
Shi et al.

(10) Patent No.: US 9,781,539 B2
(45) Date of Patent: Oct. 3, 2017

(54) ENCODING DEVICE AND METHOD, DECODING DEVICE AND METHOD, AND PROGRAM

(71) Applicant: SONY CORPORATION, Tokyo (JP)

(72) Inventors: Runyu Shi, Tokyo (JP); Toru Chinen, Kanagawa (JP); Hiroyuki Honma, Chiba (JP); Mitsuyuki Hatanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/915,812

(22) PCT Filed: Sep. 29, 2014

(86) PCT No.: PCT/JP2014/075797

§ 371 (c)(1),
(2) Date: Mar. 1, 2016

(87) PCT Pub. No.: WO2015/053109

PCT Pub. Date: Apr. 16, 2015

(65) Prior Publication Data

US 2016/0286332 A1 Sep. 29, 2016

(30) Foreign Application Priority Data

Oct. 9, 2013 (JP) ..... 2013-211878

(51) Int. Cl.
*G10L 19/16* (2013.01)
*G10L 19/008* (2013.01)
(Continued)

(52) U.S. Cl.
CPC ..... *H04S 7/308* (2013.01); *G10L 19/173* (2013.01); *H04S 3/008* (2013.01); *G10L 19/008* (2013.01); *H04S 2400/03* (2013.01)

(58) Field of Classification Search
CPC ..... H04S 7/308; H04S 3/008; H04S 2400/13; G10L 19/173; G10L 19/008
See application file for complete search history.

(56) References Cited

U.S. PATENT DOCUMENTS

2016/0134989 A1* 5/2016 Herre ..... H04S 3/002 381/20

FOREIGN PATENT DOCUMENTS

EP 2629539 A2 8/2013
JP 09-106299 4/1997
(Continued)

OTHER PUBLICATIONS

"Video Coding, Audio Coding and Multiplexing Specifications for Digital Broadcasting", ARIB STD-B32 2.2 (Obtained Oct. 9, 2013).
(Continued)

*Primary Examiner* — Sonia Gay
(74) *Attorney, Agent, or Firm* — Chip Law Group

(57) ABSTRACT

The present technology relates to an encoding device and method, a decoding device and method, and a program which can obtain high quality audio with a less code amount. A signal encoding unit encodes audio signals and outputs a resultant signal code string. A coefficient encoding unit encodes mixing coefficients for use in a mixing process of the audio signals and outputs a resultant coefficient code string. A multiplexing unit multiplexes the signal code string and the coefficient code string and outputs a resultant output code string. The coefficient encoding unit rearranges the mixing coefficients at the time of encoding the mixing coefficients on the basis of distances between input-side sound source positions and speaker positions on a reproduction side and calculates differential values between the mixing coefficients on the basis of arrangement order of the mixing coefficients, thereby encoding the mixing coeffi-
(Continued)

| Source(m) | Label | Azimuth | Elevation |
|---|---|---|---|
| 1 | FC | 0 | 0 |
| 2 | FLc | 30 | 0 |
| 3 | FRc | −30 | 0 |
| 4 | FL | 60 | 0 |
| 5 | FR | −60 | 0 |
| 6 | SiL | 90 | 0 |
| 7 | SiR | −90 | 0 |
| 8 | BL | 135 | 0 |
| 9 | BR | −135 | 0 |
| 10 | BC | 180 | 0 |
| 11 | TpFC | 0 | 35 |
| 12 | TpFL | 45 | 35 |
| 13 | TpFR | −45 | 35 |
| 14 | TpSiL | 90 | 35 |
| 15 | TpSiR | −90 | 35 |
| 16 | TpBL | 135 | 35 |
| 17 | TpBR | −135 | 35 |
| 18 | TpBC | 180 | 35 |
| 19 | TpC | 0 | 90 |
| 20 | BtFC | 0 | −15 |
| 21 | BtFL | 45 | −15 |
| 22 | BtFR | −45 | −15 |

cients. The present technology is applicable to the encoding device and the decoding device.

15 Claims, 20 Drawing Sheets

(51) Int. Cl.
*H04S 7/00* (2006.01)
*H04S 3/00* (2006.01)

(56) References Cited

FOREIGN PATENT DOCUMENTS

| | | |
|---|---|---|
| JP | 10-257600 | 9/1998 |
| JP | 2001-112083 | 4/2001 |
| JP | 2008-219881 | 9/2008 |
| JP | 2009-501943 | 1/2009 |
| WO | 2008/046531 A1 | 4/2008 |
| WO | 2012-046685 | 4/2012 |

OTHER PUBLICATIONS

Extended European Search Report of EP Patent Application No. 14852823.5, dated Apr. 28, 2017, 10 pages.
"Multichannel Sound Technology in Home and Broadcasting Applications, Report ITU-R Technology in BS.2159-4, BS Series Broadcasting Service (Sound)", May, 2012, 54 pages.

* cited by examiner

FIG.1

| Source(m) | Label | Azimuth | Elevation |
|---|---|---|---|
| 1 | FC | 0 | 0 |
| 2 | FLc | 30 | 0 |
| 3 | FRc | −30 | 0 |
| 4 | FL | 60 | 0 |
| 5 | FR | −60 | 0 |
| 6 | SiL | 90 | 0 |
| 7 | SiR | −90 | 0 |
| 8 | BL | 135 | 0 |
| 9 | BR | −135 | 0 |
| 10 | BC | 180 | 0 |
| 11 | TpFC | 0 | 35 |
| 12 | TpFL | 45 | 35 |
| 13 | TpFR | −45 | 35 |
| 14 | TpSiL | 90 | 35 |
| 15 | TpSiR | −90 | 35 |
| 16 | TpBL | 135 | 35 |
| 17 | TpBR | −135 | 35 |
| 18 | TpBC | 180 | 35 |
| 19 | TpC | 0 | 90 |
| 20 | BtFC | 0 | −15 |
| 21 | BtFL | 45 | −15 |
| 22 | BtFR | −45 | −15 |

FIG.2

| Source(m) | Label | Azimuth | Elevation |
|---|---|---|---|
| 1 | L | 30 | 0 |
| 2 | R | −30 | 0 |
| 3 | C | 0 | 0 |
| 4 | LS | 110 | 0 |
| 5 | RS | −110 | 0 |

FIG.3

| MixGain(m, n) | Target(1) | Target(2) | Target(3) | Target(4) | Target(5) |
|---|---|---|---|---|---|
| Source(1) | −∞dB | −∞dB | 0dB | −∞dB | −∞dB |
| Source(2) | −1dB | −∞dB | −1dB | −∞dB | −∞dB |
| Source(3) | −∞dB | −1dB | −1dB | −∞dB | −∞dB |
| Source(4) | 0dB | −∞dB | −∞dB | −∞dB | −∞dB |
| Source(5) | −∞dB | 0dB | −∞dB | −∞dB | −∞dB |
| Source(6) | 0dB | −∞dB | −∞dB | −1dB | −∞dB |
| Source(7) | −∞dB | 0dB | −∞dB | −∞dB | −1dB |
| Source(8) | −∞dB | −∞dB | −∞dB | 0dB | −∞dB |
| Source(9) | −∞dB | −∞dB | −∞dB | −∞dB | 0dB |
| Source(10) | −∞dB | −∞dB | −∞dB | −1dB | −1dB |
| Source(11) | −∞dB | −∞dB | 0dB | −∞dB | −∞dB |
| Source(12) | 0dB | −∞dB | −∞dB | −∞dB | −∞dB |
| Source(13) | −∞dB | 0dB | −∞dB | −∞dB | −∞dB |
| Source(14) | −1dB | −∞dB | −∞dB | −1dB | −∞dB |
| Source(15) | −∞dB | −1dB | −∞dB | −∞dB | −1dB |
| Source(16) | −∞dB | −∞dB | −∞dB | 0dB | −∞dB |
| Source(17) | −∞dB | −∞dB | −∞dB | −∞dB | 0dB |
| Source(18) | −∞dB | −∞dB | −∞dB | −1dB | −1dB |
| Source(19) | −∞dB | −∞dB | −1dB | −3dB | −3dB |
| Source(20) | −∞dB | −∞dB | 0dB | −∞dB | −∞dB |
| Source(21) | 0dB | −∞dB | −∞dB | −∞dB | −∞dB |
| Source(22) | −∞dB | 0dB | −∞dB | −∞dB | −∞dB |

FIG.5

| i | m | n | i | m | n | i | m | n | i | m | n | i | m | n |
|---|---|---|---|---|---|---|---|---|---|---|---|---|---|---|
| 1 | 2 | 1 | 23 | 3 | 2 | 45 | 1 | 3 | 67 | 8 | 4 | 89 | 7 | 5 |
| 2 | 21 | 1 | 24 | 22 | 2 | 46 | 20 | 3 | 68 | 14 | 4 | 90 | 15 | 5 |
| 3 | 1 | 1 | 25 | 1 | 2 | 47 | 2 | 3 | 69 | 8 | 4 | 91 | 9 | 5 |
| 4 | 4 | 1 | 26 | 5 | 2 | 48 | 3 | 3 | 70 | 16 | 4 | 92 | 17 | 5 |
| 5 | 12 | 1 | 27 | 13 | 2 | 49 | 11 | 3 | 71 | 4 | 4 | 93 | 5 | 5 |
| 6 | 20 | 1 | 28 | 20 | 2 | 50 | 21 | 3 | 72 | 12 | 4 | 94 | 13 | 5 |
| 7 | 11 | 1 | 29 | 11 | 2 | 51 | 22 | 3 | 73 | 21 | 4 | 95 | 22 | 5 |
| 8 | 3 | 1 | 30 | 2 | 2 | 52 | 12 | 3 | 74 | 10 | 4 | 96 | 10 | 5 |
| 9 | 6 | 1 | 31 | 7 | 2 | 53 | 13 | 3 | 75 | 18 | 4 | 97 | 18 | 5 |
| 10 | 14 | 1 | 32 | 15 | 2 | 54 | 4 | 3 | 76 | 2 | 4 | 98 | 3 | 5 |
| 11 | 22 | 1 | 33 | 21 | 2 | 55 | 5 | 3 | 77 | 19 | 4 | 99 | 19 | 5 |
| 12 | 13 | 1 | 34 | 12 | 2 | 56 | 6 | 3 | 78 | 11 | 4 | 100 | 11 | 5 |
| 13 | 5 | 1 | 35 | 4 | 2 | 57 | 7 | 3 | 79 | 20 | 4 | 101 | 20 | 5 |
| 14 | 19 | 1 | 36 | 19 | 2 | 58 | 14 | 3 | 80 | 1 | 4 | 102 | 1 | 5 |
| 15 | 16 | 1 | 37 | 17 | 2 | 59 | 15 | 3 | 81 | 9 | 4 | 103 | 8 | 5 |
| 16 | 8 | 1 | 38 | 9 | 2 | 60 | 19 | 3 | 82 | 17 | 4 | 104 | 16 | 5 |
| 17 | 7 | 1 | 39 | 6 | 2 | 61 | 16 | 3 | 83 | 3 | 4 | 105 | 2 | 5 |
| 18 | 15 | 1 | 40 | 14 | 2 | 62 | 17 | 3 | 84 | 13 | 4 | 106 | 12 | 5 |
| 19 | 18 | 1 | 41 | 18 | 2 | 63 | 8 | 3 | 85 | 22 | 4 | 107 | 21 | 5 |
| 20 | 17 | 1 | 42 | 16 | 2 | 64 | 9 | 3 | 86 | 7 | 4 | 108 | 6 | 5 |
| 21 | 10 | 1 | 43 | 10 | 2 | 65 | 18 | 3 | 87 | 15 | 4 | 109 | 14 | 5 |
| 22 | 9 | 1 | 44 | 8 | 2 | 66 | 10 | 3 | 88 | 5 | 4 | 110 | 4 | 5 |

FIG.6

| i | syn(i) | i | syn(i) | i | syn(i) | i | syn(i) | i | syn(i) |
|---|---|---|---|---|---|---|---|---|---|
| 1 | 0 | 23 | 1 | 45 | 0 | 67 | 0 | 89 | 67 |
| 2 | 0 | 24 | 2 | 46 | 0 | 68 | 0 | 90 | 68 |
| 3 | 0 | 25 | 3 | 47 | 0 | 69 | 0 | 91 | 69 |
| 4 | 0 | 26 | 4 | 48 | 47 | 70 | 0 | 92 | 70 |
| 5 | 0 | 27 | 5 | 49 | 0 | 71 | 0 | 93 | 71 |
| 6 | 0 | 28 | 6 | 50 | 0 | 72 | 0 | 94 | 72 |
| 7 | 0 | 29 | 7 | 51 | 50 | 73 | 0 | 95 | 73 |
| 8 | 0 | 30 | 8 | 52 | 0 | 74 | 0 | 96 | 74 |
| 9 | 0 | 31 | 9 | 53 | 52 | 75 | 0 | 97 | 75 |
| 10 | 0 | 32 | 10 | 54 | 0 | 76 | 0 | 98 | 76 |
| 11 | 0 | 33 | 11 | 55 | 54 | 77 | 0 | 99 | 77 |
| 12 | 0 | 34 | 12 | 56 | 0 | 78 | 0 | 100 | 78 |
| 13 | 0 | 35 | 13 | 57 | 56 | 79 | 0 | 101 | 79 |
| 14 | 0 | 36 | 14 | 58 | 0 | 80 | 0 | 102 | 80 |
| 15 | 0 | 37 | 15 | 59 | 58 | 81 | 0 | 103 | 81 |
| 16 | 0 | 38 | 16 | 60 | 0 | 82 | 0 | 104 | 82 |
| 17 | 0 | 39 | 17 | 61 | 0 | 83 | 0 | 105 | 83 |
| 18 | 0 | 40 | 18 | 62 | 61 | 84 | 0 | 106 | 84 |
| 19 | 0 | 41 | 19 | 63 | 0 | 85 | 0 | 107 | 85 |
| 20 | 0 | 42 | 20 | 64 | 63 | 86 | 0 | 108 | 86 |
| 21 | 0 | 43 | 21 | 65 | 0 | 87 | 0 | 109 | 87 |
| 22 | 0 | 44 | 22 | 66 | 0 | 88 | 0 | 110 | 88 |

FIG.7

```
t=1;
while(MixGain(i-t)==-∞ && t<i){
    t=t+1;
}
if t==i,{
    MixGain_diff(i)=MixGain(i);
}else{
    MixGain_diff(i)=MixGain(i)-MixGain(i-t);
}
```

FIG.8

| MixGain_diff(dB) | CODE | bit_length |
|---|---|---|
| 4 | 01111 | 5 |
| 3 | 11011 | 5 |
| 2 | 01110 | 5 |
| 1 | 110101 | 6 |
| 0 | 00 | 2 |
| −1 | 010 | 3 |
| −2 | 100 | 3 |
| −3 | 101 | 3 |
| −4 | 0110 | 4 |
| −5 | 110100 | 6 |
| −6 | 1100 | 4 |
| other | 111+FIX | 3+5 |

FIG.9

| Header Syntax | No. of bits | Mnemonic |
|---|---|---|
| if(DMX_coef_exist_flag== "1" ){ | 1 | uimsbf |
| Number_of_mix_coef | 3 | uimsbf |
| for(idmx=0;idmx<Number_of_mix_coef;idmx++){ | | |
| Spk_config_idx[idmx]; | 3 | uimsbf |
| } | | |
| Use_differential_coding_flag | 1 | uimsbf |
| Use_symmetry_infomation_flag | 1 | uimsbf |
| Quantization_level | 2 | uimsbf |
| } | | |

FIG.10

| Data Syntax | No. of bits | Mnemonic |
|---|---|---|
| data() { | | |
| 011 012 if(Mix_gain_changed_flag=="1") { | 1 | uimsbf |
| if(Use_symmetry_information_flag=="1") { | | |
| for(idx=0;idx<Number_of_mix_coef;idx++) { | | |
| all_gain_symmetric_flag[idx]; | 1 | uimsbf |
| for(i=0;i<Number_of_mix_coef[Speaker_config_idx[idx]];i++) { | | |
| if(Symmetry_info_tbl[Speaker_config_idx[idx]][i]>0) { | | |
| if(all_gain_symmetric_flag[idx]=="1") { | | |
| if(Symmetry_info_flag[idx][i]=="1") { | 1 | uimsbf |
| if(Linear_Inf_flag[idx][i]=="1") { | 1 | uimsbf |
| Mix_Gain_diff[idx][i]; | nBits_data_diff | vlclbf |
| } | | |
| } | | |
| } | | |
| 013 else { | | |
| if(Linear_Inf_flag[idx][i]=="1") { | 1 | uimsbf |
| Mix_Gain_diff[idx][i]; | nBits_data_diff | vlclbf |
| } | | |
| } | | |
| } | | |
| } | | |
| 014 else { | | |
| for(idx=0;idx<Number_of_asymmix_variation;idx++) { | | |
| for(i=0;i<Number_of_mix_coef[Speaker_config_idx[idx]];i++) { | | |
| if(Linear_Inf_flag[idx][i]=="1") { | 1 | uimsbf |
| Mix_Gain_diff[idx][i]; | nBits_data_diff | vlclbf |
| } | | |
| } | | |
| } | | |
| } | | |
| } | | |
| } | | |

ENCODING DEVICE AND METHOD, DECODING DEVICE AND METHOD, AND PROGRAM

TECHNICAL FIELD

The present technology relates to as encoding device and method, a decoding device arid method, and a program and particularly relates to an encoding device and method, a decoding device and method, sad a program which can obtain high quality audio with a less transferring code amount.

BACKGROUND ART

In reproduction of multichannel audios, speaker arrangement on a reproduction side and sound source positions of audio signals to be reproduced are desired to be completely the same. In reality, however, the speaker arrangement on the reproduction side is not the same as the sound source positions in most cases.

There is a sound source that does not exist in positions of the speakers due to a difference between the speaker arrangement on the reproduction side and the sound source positions, and therefore how to reproduce such a sound source attracts great attention.

In order to obtain audio signals corresponding to the speaker arrangement on the reproduction side, generally, audio signals of the respective sound source positions, i.e., respective channels are mixed by using mixing equations, and audio signals of new channels corresponding to the speakers on the reproduction side are generated.

In this case, conventionally, an appropriate pattern is selected from several patterns provided in advance as a parameter in mixing equations set in advance, and mixing coefficients to be multiplied by the audio signals of the respective channels in fee mixing equations are calculated (i.e., see Non-patent Literature 1).

For example, Non-patent Literature 1 discloses that the following equations (1) are calculated as down-mixing of 22.2 channel arrangement to 5.1 channel arrangement in the standard ARIB STD-B32 version 2.2 [1] of Association of Radio Industries and Businesses (ARIB).

[Math. 1]

$$L = a\left(FL + \frac{1}{\sqrt{2}}(FLc + SiL) + k\left(TpFL + \frac{1}{\sqrt{2}}(TpSiL) + BtFL\right)\right) \quad (1)$$

$$R = a\left(FR + \frac{1}{\sqrt{2}}(FRc + SiR) + k\left(TpFR + \frac{1}{\sqrt{2}}(TpSiR) + BtFR\right)\right)$$

$$C = a\left(FC + \frac{1}{\sqrt{2}}(FLc + FRc) + k\left(TpFC + \frac{1}{\sqrt{2}}(TpC) + BtFC\right)\right)$$

$$LS = a\left(BL + \frac{1}{\sqrt{2}}(SiL + BC) + k\left(TpBL + \frac{1}{\sqrt{2}}(TpSiL + TpBC) + \frac{1}{2}TpC\right)\right)$$

$$RS = a\left(BR + \frac{1}{\sqrt{2}}(SiR + BC) + k\left(TpBR + \frac{1}{\sqrt{2}}(TpSiR + TpBC) + \frac{1}{2}TpC\right)\right)$$

$$LFE = \frac{1}{\sqrt{2}}(LFE1 + LFE2)$$

$$a = \frac{\sqrt{2}}{3} \cdot \frac{2}{3}$$

$$k = 1, \frac{1}{\sqrt{2}}, \frac{1}{2}, \frac{1}{2\sqrt{2}}$$

In the equations (1), audio signals of channels such as FL, FR, and FC in 22.2 channel arrangement are added by using mixing coefficients to calculate audio signals of channels L, R, C, LS, RS, and LFE after down-mixing. In the equations (1), one of two values can be selected as a parameter a, and one of four values can be selected as a parameter k.

The coefficients multiplied in the equations (1) by the channels before down-mixing to obtain audio signals of the respective channels after down-mixing are mixing coefficients. For example, in the equations (1), a mixing coefficient multiplied by as FL channel to obtain as L channel is a value of the parameter a, and a mixing coefficient multiplied by an Fix channel to obtain the L channel is $a/(2^{1/2})$. Note that, hereinafter, a channel will also be simply referred to as "ch".

CITATION LIST

Non-Patent literature

Non-patent Literature 1; VIDEO CODING, AUDIO CODING AND multiplexing SPECIFICATIONS FOR DIGITAL-BROADCASTING, [online], Jul. 29, 2009, Association of Radio industries and Businesses, [searched on Sep. 30, 2013], Internet <http://www.arib.or.jp/english/html/overview/doc/2-STD-B32v2_2. pdf>

SUMMARY OF INVENTION

Technical Problem

However, in a method of performing down-mixing by using the equations (1), mixing equations and parameters in the equations to be selected are prepared in advance, and therefore only mixing coefficients calculated on the basis of the parameters and the mixing equations can be used.

In order to provide high quality audio to viewers, the mixing coefficients needs to be freely changed In accordance with various scenes of contents of sound sources.

However, in order to transfer completely free mixing coefficient, it is necessary to independently transfer all mixing coefficients to output speakers from input sound sources.

Therefore, in the case where the number of the input sound sources is M channels and the number of the output speakers is N, the number of mixing coefficients is M×N. In the case where the mixing coefficients are transferred with Q bit(s) for each mixing coefficient, a data amount of a set of the mixing coefficients is M×N×Q hits. For example, in the case where the input sound sources are 22 ch, the output speakers are 5 ch channels, and 5 bits are necessary for each mixing coefficient, 550 bits are necessary in total.

Further, is some cases, it is necessary to transmit a plurality of sets of mixing coefficients in accordance with a plurality of patterns of speaker arrangement because a transmission side does not know actual speaker arrangement on the reproduction side. For example, in the case where speaker arrangement on an output side may be 7 ch, 5 ch, or 2 ch, it is necessary to transmit three sets of mixing coefficients, i.e., mixing coefficients for down-mixing from 22 ch to 5 ch, from 22 ch to 7 ch, and from 22 ch to 2 ch. In the case where the above mixing coefficients themselves are transferred, an enormous amount of information is generated. Therefore, how to transfer free mixing coefficients is important.

As described above, in the above technology, it is difficult to transfer free mixing coefficients with a less code amount to obtain high quality audio on the reproduction side.

The present technology has been made in view of the circumstances and can obtain high quality audio with a less code amount.

Solution to Problem

An encoding device according to a first aspect of the present technology includes: an order table generation unit configured to generate an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers; a rearrangement unit configured to rearrange the plurality of mixing coefficients in the order shown in the order table; a difference calculation unit configured to calculate a differential value between two consecutive mixing coefficients among the mixing coefficients rearranged in the order; and an encoding unit configured to encode the differential value calculated for each of the mixing coefficients.

The encoding unit can further include: a symmetry table generation unit configured to generate a symmetry table showing symmetry of a positional relationship between the mixing coefficients; and a symmetry determination unit configured to determine, on the basis of the symmetry table, that, in the case where the mixing coefficient and another mixing coefficient having the positional relationship symmetric to the mixing coefficient have the same value, the mixing coefficient and the other mixing coefficient are symmetric. The encoding unit can be configured not to encode the differential value of the mixing coefficient determined to be symmetric to the other mixing coefficient.

The symmetry determination unit can further determine whether or not each of all the mixing coefficients having the positional relationship symmetric to the other mixing coefficient is symmetric to the corresponding another mixing coefficient having the symmetric positional relationship. The encoding unit can encode the differential value on the basis of a result of determination on whether or not all the mixing coefficients are symmetric to the other mixing coefficient.

The encoding unit can perform entropy encoding with respect to the differential value.

In the case where the input speaker for the mixing coefficient and the input speaker for the other mixing coefficient are positioned to have left-right symmetry and the output speaker for the mixing coefficient and the output speaker for the other mixing coefficient are positioned to have left-right symmetry, the positional relationship between the mixing coefficient and the other mixing coefficient can be symmetric.

The difference calculation unit can calculate the differential value between the mixing coefficient and a mixing coefficient having a value that is not $-\infty$ and having the order closest to the order of the mixing coefficient.

The order table generation unit can generate the order table by classifying the mixing coefficients into a plurality of classes so that, in the case where the number of the input speakers is larger than the number of the output speakers, the mixing coefficients of the same output speakers belong to the same class while classifying the mixing coefficients into a plurality of classes so that, in the case where the number of the output speakers is larger than the number of the input speakers, the mixing coefficients of the same input speakers belong to the same class and determining arrangement order of the mixing coefficients in each of the classes. The difference calculation unit can calculate the differential value between the mixing coefficients belonging to the same class.

An encoding method or a program according to the first aspect of the present technology includes the steps of: generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for convening audio signals of a plurality of channels corresponding to arrangement of the plurality of input speakers into audio signals of a plurality of channels corresponding to arrangement of the plurality of output speakers; rearranging the plurality of mixing coefficients in the order shown in the order table; calculating a differential value between two consecutive mixing coefficients among the mixing coefficients rearranged in the order; and encoding the differential value calculated for each of the mixing coefficients.

According to the first aspect of the present technology, an order table showing arrangement order of mixing coefficients determined on the basis of distances between a plurality of input speakers and a plurality of output speakers is generated, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers; the plurality of mixing coefficients are rearranged in the order shown in the order table; a differential value between two consecutive mixing coefficients among the mixing coefficients rearranged in the order is calculated; and the differential value calculated for each of the mixing coefficients is encoded.

A decoding device according to a second aspect of the present technology includes: an order table generation unit configured to generate an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers; a decoding unit configured to acquire a code string obtained by calculating a differential value between two consecutive mixing coefficients arranged in the order shown in the order table and encoding the differential value calculated for each of the mixing coefficients and decode the code string; an addition unit configured to add the differential value obtained by the decoding to one of the mixing coefficients used for calculating the differential value on the basis of the order table to calculate the other one of the mixing coefficients used for calculating the differential value; and a rearrangement unit configured to rearrange the mixing coefficients on the basis of the order table and output the mixing coefficients.

In the case where the mixing coefficient and another mixing coefficient having a positional relationship symmetric to the mixing coefficient have the same value, the mixing coefficient and the other mixing coefficient can be symmetric, and the differential value of the mixing coefficient is not encoded. The decoding device can further include a symmetry table generation unit configured to generate a symmetry table showing the positional relationship between the mixing coefficients. In the case where the mixing coefficient and the other mixing coefficient are symmetric, the addition unit can copy the other mixing coefficient on the basis of the symmetry table and can set the other mixing coefficient as the mixing coefficient.

The differential value can be encoded on the basis of a result of determination on whether or not each of all the mixing coefficients having the positional relationship symmetric to the other mixing coefficient is symmetric to the corresponding another mixing coefficient having the symmetric positional relationship. The decoding unit can decode the differential value on the basis of information indicating a result of determination on whether or not all the mixing coefficients are symmetric to the other mixing coefficient, the information being contained in the code string.

In the case where the input speaker for the mixing coefficient and the input speaker for the other mixing coefficient are positioned to have left-right symmetry and the output speaker for the mixing coefficient and the output speaker for the other mixing coefficient are positioned to have left-right symmetry the positional relationship between the mixing coefficient and the other mixing coefficient can be symmetric.

A decoding method or a program according to the second aspect of the present technology includes the steps of; generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers; acquiring a code string obtained by calculating a differential value between two consecutive mixing coefficients arranged in the order shown in the order table and encoding the differential value calculated for each of the mixing coefficients and decoding the code string; adding the differential value obtained by the decoding to one of the mixing coefficients used for calculating the differential value on the basis of the order table to calculate the other one of the mixing coefficients used for calculating the differential value; and rearranging the mixing coefficients on the basis of the order table and outputting the mixing coefficients.

According to the second aspect, an order table showing arrangement order of mixing coefficients determined on the basis of distances between a plurality of input speakers and a plurality of output speakers is generated, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers; a code siring obtained by calculating a differential value between two consecutive mixing coefficients arranged in the order shown in the order table and encoding the differential value calculated for each of the mixing coefficients and decoding the code string is acquired; the differential value obtained by the decoding is added to one of the raising coefficients used for calculating the differential value on the basis of the order table to calculate the other one of the mixing coefficients used for calculating the differential value; and the mixing coefficients are rearranged and on the basis of the order table and the mixing coefficients are output.

Advantageous Effects of Invention

According to the first aspect and the second aspect of the present technology, it is possible to obtain high quality audio with a less code amount.

Note that advantageous effects are not limited to the advantageous effect described herein and may be any advantageous effects described in the present disclosure.

BRIEF DESCRIPTION OF DRAWINGS

FIG. 1 shows an example of speaker arrangement

FIG. 2 shows an example of speaker arrangement.

FIG. 3 shows examples of mixing coefficients.

FIG. 5 shows an example of a transferring order table.

FIG. 6 shows an example of a symmetry table.

FIG. 7 is a diagram for explaining calculation of a differential value.

FIG. 8 shows examples of cord words.

FIG. 9 shows syntax of a header.

FIG. 10 shows syntax of a coefficient code string.

DESCRIPTION OF EMBODIMENTS

Figure 4:
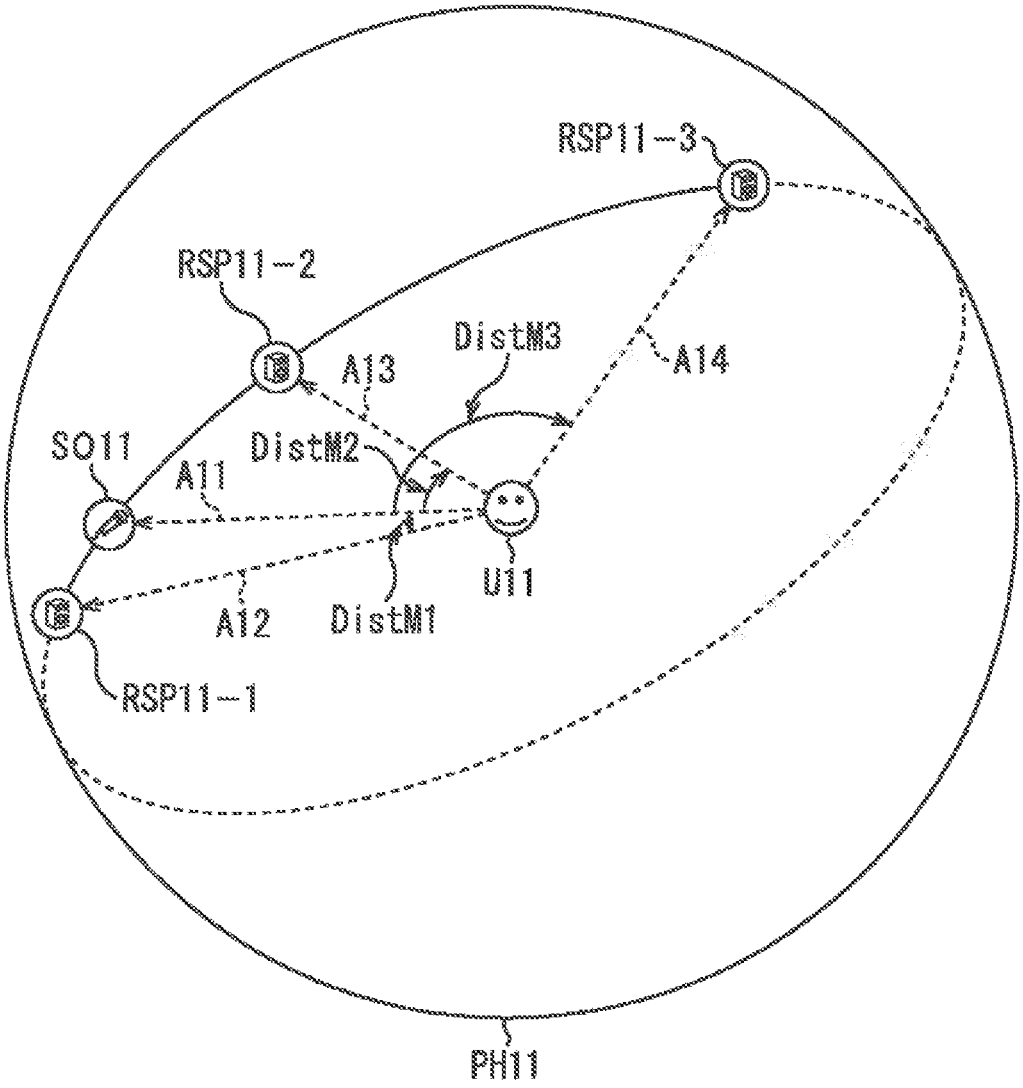
FIG. 4 is a diagram for explaining distances between a sound source position and speaker positions.

Hereinafter, an embodiment to which the present technology is applied will be described with reference to drawings.

<Embodiment 1>

<Overview of Present Technology>

An overview of the present technology will be described.

The present technology relates to encoding and decoding technologies capable of transferring arbitrary mixing coefficients with a small number of bits.

Note that, hereinafter, a sound source position of an audio signal and an arrangement position of a speaker are expressed by a horizontal angle θ (−180°≤θ≤+180°) and a vertical angle γ (−90°≤γ≤+90°).

For example, speakers are arranged to surround a user on a reproduction side, and a position directly is font of the user is a position at the horizontal angle θ=0 and the vertical angle γ=0. The horizontal angle θ indicates a crosswise angle seen from the user, whereas the vertical angle γ indicates a lengthwise angle seen from the user. Specifically, for example, a left direction seen from the user is a positive direction of the horizontal angle θ and an upward direction seen from the user is a positive direction of the vertical angle γ.

Hereinafter, description will be provided as appropriate by using an example where sound sources that are assumed to be reproduced in 22 ch speaker arrangement are reproduced in 5 ch speaker arrangement by rising the 22 ch speaker arrangement and the 5 ch speaker arrangement that are obtained by removing LFE from 22.2 ch defined by the 22.2 multichannel sound system [2] and removing LFE from 5.1 ch defined by the international standard ITU-R BS. 775-1[3]. Note that the 22.2 multichannel sound system [2] is disclosed in detail in [2] Kimio Hamasaki, "Tendency of standardization of 22.2 multichannel sound system", NHK Science & Technology Research Laboratories, R&D, No. 126, 2011. 3. <http://www.nhk.or.jp/strl/publica/rd/rd126/PDF/P04-13.pdf>. The international standard ITU-R BS. 775-1[3] is disclosed in detail in [3] ITU-R BS, 775-1, "Multichannel Stereophonic Sound System with and without accompanying Picture," Rec., International Telecommunications Union, Geneva, Switzerland (1992-1994).

Herein, as examples of speaker arrangement positions (sound source positions) based on the 22.2 multichannel sound system [2] and the international standard ITU-R BS. 775-1[3], speaker arrangement positions (sound source positions) of respective channels of 22 ch are positions shown in FIG. 1, and speaker arrangement positions of respective channels of 5 ch are positions shown in FIG. 2.

Note that, in FIG. 1 and FIG. 2, Source(m) indicates numbers identifying the respective channels, and Label indicates names of the respective channels. Further, in FIG. 1 and FIG. 2, Azimuth indicates horizontal angles θ of the speaker positions (sound source positions) of the respective channels, and Elevation indicates vertical angles γ of the speaker positions (sound source positions) of the respective channels.

FIG. 1 shows speaker arrangement positions of the channels FC, FLc, FRc, FL, FR, SiL, SiR, BL, BR, BC, TpFC, TpFL, TpFR, TpSiL, TpSiR, TpBL, TpBR, TpBC, TpC, BtFC, BtFL, and BtFR, FIG. 2 shows speaker arrangement positions of the channels L, R, C, LS, and RS.

For example, the arrangement position of the speaker for the FC channel specified by Source(m)=1 in FIG. 1 is a position at the horizontal angle θ=0 and the vertical angle γ=0. This means that a speaker arranged directly in front of a user is a speaker that reproduces an audio signal of the FC channel.

Hereinafter, encoding of mixing coefficients using the present technology will be specifically described.

The following process STP1 to process STP6 are mainly performed in an encoding process of mixing coefficients. Note that the process STP1 and the process STP2 are performed as so-called preparatory work.

(Process STP1): A transferring order table is generated on the basis of distances between sound sources and speakers on a reproduction side (Process STP2): A symmetry table showing symmetry between pairs of the sound sources and the speakers on the reproduction side is generated (Process STP3): Transferring order of mixing coefficients is changed on the basis of the transferring order table, and then differential values between the mixing coefficients are calculated (Process STP4): Symmetry between the mixing coefficients is determined (Process STP5): Encoding based on the symmetry between the mixing coefficients is performed (Process STP6): The differential values between the mixing coefficients are encoded Herein, mixing coefficients will be described.

For example, it is assumed to perform a mixing process for converting audio signals of M channels corresponding to arrangement of M speakers, i.e., audio signals of M channels that reproduce M sound source positions into audio signals of N channels to be reproduced by N speakers. In this case, mixing coefficients of the respective M speakers (sound source positions) are prepared in advance for each of the N speakers.

Herein, regarding M×N mixing coefficients prepared in advance, a mixing coefficient of the mth sound source position used to obtain an audio signal of the nth speaker is defined as MixGain(m,n). Assuming that the mixing coefficient MixGain(m,n) is a discrete value quantised by resolution set in advance, in the case where, for example, the quantized resolution is 1 dB and the mixing coefficient falls within a range of 3 dB to −27 dB and −∞ dB, each mixing coefficient can be expressed with Q=5 bits.

As an example, in the case of the parameter $a=(2^{1/2})/3$ and the parameter k=1 in parts other than an LFE channel among down-mixing coefficients for down mixing from 22.2 ch arrangement to 5.1 ch arrangement in the ARIB STD-B32 version 2.2 [1], mixing coefficients of the respective channels are shown in FIG 3.

Note that, in FIG 3, Source(1) to Source(22) indicate numbers identifying the respective channels in the 22.2 ch arrangement and correspond to Source(m)=1 to Source(m)=22 shown in FIG. 1. Further, in FIG 3, Target(1) to Target(5) indicate numbers identifying the respective channels in the 5.1 ch arrangement and correspond to Source(m)=1 to Source(m)=5 shown in FIG. 2.

Hereinafter, M sound source positions (Source) of audio signals to be input are also referred to as "Source(1) to Source(M)" and N speaker positions (Target) on the reproduction side are also referred to as Target(1) to Target(N).

A sound source position Source(m) of the mth channel (1≤m≤M) of an audio signal to be input is expressed by the horizontal angle $\theta=\theta_m$ and the vertical angle $\gamma=\gamma_m$, and the nth (1≤n≤N) speaker position Target(n) on the reproduction side is expressed by the horizontal angle $\theta=\theta_n$ and the vertical angle $\gamma=\gamma_n$.

The process STP1 to the process STP6 described above will be described in more detail.

<Process STP1>

The process STP1 will be described.

In the process STP1, a process STP1(1) to a process STP1(4) are performed, and a transferring order table showing order to transfer mixing coefficients is generated.

In the process STP1(1), distances between each of the M sound source positions and the N speakers are calculated.

For example, as illustrated in FIG 4, a sound source SO11 of an audio signal to be reproduced and a speaker RSP11-1 to a speaker RSP11-3 on a reproduction side are arranged on a surface of a sphere PH11 having a position of a user U11 who is a viewer as a center.

In this example, a position of the sound source SO11 is the sound source position Source(m), and positions of the speaker RSP11-1 to the speaker RSP11-3 are the speaker positions Target(n). Note that, hereinafter, in the case where it is unnecessary to distinguish the speaker RSP11-1 to the speaker RSPH-3 is particular, those speakers will also be simply referred to as "speakers RSP11". In this example, although a single sound source and three speakers are shown in FIG. 4, other sound sources and speakers also exist in actuality.

A distance between the sound source SOU and the speaker RSP11 is an angle between a vector toward a direction of the sound source SO11 from the user U11 serving as a start point and a vector toward a direction of the speaker RSP11 from the user U11 serving as a start point.

In other words, the distance between the sound source SO11 and the speaker RSP11 is a distance between the sound source SO11 and the speaker RSP11 on the surface of the sphere PH11, i.e., a length of an arc connecting the sound source SO11 and the speaker RSP11.

In the example of FIG 4, an angle between an arrow A11 and an arrow A12 is defined as a distance DistM1 between the sound source SO11 and the speaker RSP11-1. Similarly, an angle between the arrow A11 and an arrow A13 is defined as a distance DistM2 between the sound source SO11 and the speaker RSP11-2, and an angle between the arrow A11 and an arrow A14 is defined as a distance DistM3 between the sound source SO11 and the speaker RSP11-3.

For example, a three-dimensional coordinate system having the position of the user U11 as an origin and constituted by an x-axis, a y-axis, and a z-axis will be considered with reference to FIG 4.

Herein, assuming that a plane including a straight line in a depth direction in FIG. 4 and a straight line in a crosswise direction in FIG. 4 is an xy plane, an angle on the xy plane between a straight line in a reference direction on the xy plane, i.e., for example, the y-axis, and a vector is a sound source direction or a speaker direction from the user U11 serving as a start point is tire horizontal angle θ. That is, the horizontal angle θ is an angle in a horizontal direction in FIG 4. An angle between a vector in the sound source direction or the speaker direction from the user U11 serving as a start point arid the xy plane is the vertical angle γ.

Therefore, a distance Dist(m,n) between the sound source position Source(m) of the mth channel (1≤m≤M) and the nth (1≤n≤N) speaker position Target(n) can be obtained by calculating the following equation (2).

[Math. 2]

$$\mathrm{Dist}(m,n)=\arccos[\cos\theta_m\times\cos\theta_n\times\cos(\gamma_m-\gamma_n)+\sin\theta_m\times\sin\theta_n](0^\circ\leq\mathrm{Dist}(m,n)\leq 180^\circ) \quad (2)$$

Note that, in the equation (2), $\theta_m$ and $\gamma_m$ indicate the horizontal angle θ and the vertical angle γ of the sound source position Source(m), and $\theta_n$ and $\gamma_n$ indicate the horizontal angle θ and the vertical angle γ of the speaker position Target(n).

In the process STP1(1), the equation (2) is calculated, and, all M×N distances Dist(m,n) between each of the M sound source positions and the N speakers are obtained.

When all the distances Dist(m,n) between the sound source positions and the speaker positions are obtained in the process STP1(1), then the M×N mixing coefficients MixGain(m,n) are classified in the process STP1(2).

Specifically, in the case of M≥N, i.e., in the case where the number M of the sound sources is equal to or larger than the number N of the speakers, mixing coefficients MixGain(m, n) of the same nth speaker belong to the same class, and the M×N mixing coefficients MixGain(m,n) are classified into N classes. In other words, mixing coefficients MixGain(m,n) whose index n indicating a speaker has the same value are classified as mixing coefficients belonging to the nth class (1≤n≤N).

In such a case, a down-mixing process or a mixing process for converting audio signals into audio signals of the same number of channels is performed as a mixing process on the reproduction side.

On the contrary, in the case of M<N, i.e., in the case where the number M of the sound sources is less than the number N of the speakers, mixing coefficients MixGain(m,n) of the same mth sound source belong to the same class, and the M×N mixing coefficients MixGain(m,n) are classified into M classes. In other words, mixing coefficients MixGain(m, n) whose index m indicating a sound source has the same value are classified as mixing coefficients belonging to the mth class (1≤m≤M).

In this case, an up-mixing process is performed as a mixing process on the reproduction side.

In the process STP1(3), the mixing coefficients MixGain (m,n) belonging to each class classified in the process STP1(2) are sorted.

Specifically, in the case where the mixing coefficients are classified into the N classes, M mixing coefficients belonging to the nth class are rearranged in ascending order of the distance Dist(m,n) to the nth speaker.

Meanwhile, in the case where the mixing coefficients are classified into the M classes, N mixing coefficients belonging to the mth class are rearranged in ascending order of the distance Dist(m,n) from the mth sound source.

After the process STP1(3) is performed, in the process STP1(4), a transferring order table showing transferring order of the mixing coefficients is generated so that the mixing coefficients belonging to each of the M or N classes are transferred in the order rearranged in the process STP1 (3).

Note that, although it is possible to freely determine which class including mixing coefficients is preferentially transferred between different classes, it is desirable to comply with order defined by the international standard or an industry standard.

For example, in the case where the number of input-side sound source positions, i.e., the number of channels of audio signals to be input is 22 ch, the number of output-side speakers, i.e., the number of channels of audio signals to be output is 5 ch. and speaker arrangement positions are the arrangement positions shown in FIG. 1 and FIG. 2, the transferring order table is as shown in FIG. 5.

Note that, in FIG. 5, i indicates the transferring order of the mixing coefficients, and m and n indicate indexes m and n in the mixing coefficient MixGain(m,n). That is, m indicates the mth sound source position Source(m), and n indicates the nth speaker position Target(n).

Therefore, for example, the ith=first mixing coefficient to be transferred is a mixing coefficient MixGain(2,1) that is used to obtain an audio signal reproduced by a speaker at the nth=first speaker position Target(1) and is multiplied by an audio signal at the mth=second sound source position Source(2).

Because FIG. 5 shows the case of M=22≥N=5, the transferring order table is generated by classifying the mixing coefficients into the N classes. That is, mixing coefficients having n=1, i.e., mixing coefficients whose transferring order i is from 1 to 22, are classified as a first class, and mixing coefficients having n=2, i.e., mixing coefficients whose transferring order i is from 23 to 44, are classified as a second class.

Similarly, mixing coefficients having n=3, i.e., mixing coefficients whose transferring order i is from 45 to 66, are classified as a third class. Mixing coefficients having n=4, i.e., mixing coefficients whose transferring order i is from 67 to 88, are classified as a fourth class. Mixing coefficients having n=5, i.e., mixing coefficients whose transferring order i is from 89 to 110, are classified as a fifth class.

Note that, hereinafter, a mixing coefficient MixGain(m,n) to be transferred ith in the transferring order table is also referred, to as "mixing coefficient MixGain(i)".

Generally, the closer a distance between a sound source and a speaker is, the larger a value of a mixing coefficient of the sound source related to the speaker is. Therefore, when the transferring order of the mixing coefficients is rearranged in accordance with a positional relationship between the sound source and the speaker, it is more likely that two mixing coefficients adjacent in terms of the transferring order have close values. Therefore, distribution of differences between the mixing coefficients is expected to be concentrated in negative values close to 0. This makes it possible to improve efficiency of entropy encoding of the mixing coefficients.

Note that the reason why mixing coefficients are classified into classes having a smaller number between the number M of the sound sources and the number N of the speakers is the process STP1(2) is that, in encoding of the mixing coefficients described below, when (lie number of classes is decreased, the number of mixing coefficients which are encoded without calculating differential values therebetween is decreased. As described above, when the number of the mixing coefficients whose values are encoded instead of encoding the differential values is decreased, it is possible to reduce a code amount of a code string transferred to the reproduction side.

<Process STP2>

The process STP2 will be described.

A symmetry table is generated in the process STP2. Specifically, when the symmetry table is generated, the transferring order table is used, and, regarding each mixing coefficient, whether or not a mixing coefficient having a symmetric positional relationship with the mixing coefficient is specified. Then, a table showing a result of the specification is generated as the symmetry table.

In the case where two sound source positions Source(m1) and Source(m2) have a positional relationship of left-right symmetry seen from a user, it is determined that the sound source position Source(m1) and the sound source position Source(m2) are symmetric.

That is, in the case where a horizontal angle $\theta_{m1}$ and a vertical angle $\gamma_{m1}$ of the sound source position Source(m1) and a horizontal angle $\theta_{m2}$ and a vertical angle $\gamma_{m2}$ of the sound source position Source(m2) satisfy $\theta_{m1}=-\theta_{m2}$ and $\gamma_{m1}=\gamma_{m2}$, it is determined that the sound source position Source(m1) and the sound source position Source(m2) are symmetric.

Similarly, in the case where two speaker positions Target (n1) and Target(n2) have a positional relationship of left-right symmetry seen from a user, it is determined that the speaker position Target(n1) and the speaker position Target (n2) are symmetric. That is, in the case where a horizontal angle $\theta_{n1}$ and a vertical angle $\gamma_{n1}$ of the speaker position Target(n1) and a horizontal angle $\theta_{n2}$ and a vertical angle $\gamma_{n2}$ of the speaker position Target(n2) satisfy $\theta_{n1}=-\theta_{n2}$ and $\gamma_{n1}=\gamma_{n2}$, it is determined that the speaker position Target(n1) and the speaker position Target(n2) are symmetric.

With respect to a mixing coefficient MixGain(m1,n1) of the sound source position Source(m1) related to the speaker position Target(n1), there is a mixing coefficient MixGain (m2,n2) of the sound source position Source(m2) symmetric to the sound source position Source(m1) regarding the speaker position Target(n2) symmetric to the speaker position Target(n1). In such a case, the mixing coefficient MixGain(m1,n1) and the mixing coefficient MixGain(m2, n2) have a symmetric positional relationship.

That is, mixing coefficients whose corresponding speaker positions are symmetric and corresponding sound source positions are symmetric are mixing coefficients having a symmetric positional relationship.

When the symmetry table is generated, the mixing coefficients having the transferring order shown in the transferring order table are sequentially processed. The mixing coefficients are selected in order from a mixing coefficient having the ith=first transferring order, i.e., in ascending order from a mixing coefficient having the earliest transferring order. Further, regarding the mixing coefficient MixGain(i) to be processed having the ith transferring order, it is determined whether or not a mixing coefficient MixGain (i') having a symmetric positional relationship with the mixing coefficient MixGain(i) having the ith transferring order exists in a range from the mixing coefficient having the first order to a mixing coefficient having the (i−1)th order.

As a result, in the case where the mixing coefficient MixGain(i') having a symmetric positional relationship with the mixing coefficient MixGain(i) exists, transferring order i' of the mixing coefficient MixGain(i') is written in the symmetry table as a symmetry value syn(i) of the mixing coefficient MixGain(i).

On the contrary, in the case where there is no mixing coefficient MixGain(i') having a symmetric positional relationship with the mixing coefficient MixGain(i), 0 is written in the symmetry table as the symmetry value syn(i) of the mixing coefficient MixGain(i). The symmetry value syn(i)= 0 indicates that there is no mixing coefficient having a symmetric positional relationship with the mixing coefficient MixGain(i).

Note that, because there is no mixing coefficient having transferring order earlier than the ith=first transferring order, the mixing coefficient MixGain(1) having the ith=first transferring order has a symmetry value syn (1) of 0.

As described above, the symmetry table is generated on the basis of the transferring order table and the positional relationship between the mixing coefficients. For example, in the case where the number of the input-side sound source positions, i.e., the number of channels of audio signals to be input is 22 ch, the number of the output-side speakers, i.e., the number of channels of audio signals to be output is 5 ch, and the speaker arrangement positions are the arrangement positions shown in FIG. 1 and FIG. 2, a symmetry table shown in FIG. 6 is obtained.

Note that, in FIG 6, i indicates the transferring order of the mixing coefficients, and syn(i) indicates a symmetry value of the mixing coefficient MixGain(i) having the ith transferring order.

In this example, the syn(i) of a mixing coefficient MixGain(23) having the ith=23th transferring order is 1, and therefore it is found that the mixing coefficient MixGain(23) has a symmetric positional relationship with the mixing coefficient MixGain(1).

<Process STP3>

In the process STP3 subsequent to the process STP2, a process STP3(1) to a process STP3(3) described below are performed, and a differential value between mixing coefficients is calculated.

That is, in the process STP3(1), it is determined whether or not arrangement order of the mixing coefficients to be transferred to the reproduction side is the order shown in the transferring order table. In the case where it is determined that the arrangement order is not the transferring order shown in the transferring order table, the mixing coefficients are rearranged in the transferring order shown in the transferring order table.

In the process STP3(2), regarding all the mixing coefficients MixGain(i) to be transferred, whether or not a value of each mixing coefficient MixGain(i) is −∞ dB is specified, and a result of the specification is temporarily stored as a flag Minus_Inf_flag(i).

For example, in the case where the value of the mixing coefficient MixGain(i) is −∞ dB, the flag Minus_Inf_flag(i) of the mixing coefficient MixGain(i) is 0, meanwhile, in the case where the value of the mixing coefficient MixGain(i) is not −∞ dB, the flag Minus_Inf_flag(i) of the mixing coefficient MixGain(i) is 1.

In the process STP3(3), among mixing coefficients from a second mixing coefficient from the top to the last mixing coefficient is each class in the transferring order table, a differential value between a mixing coefficient MixGain(i) whose value is not −∞ dB and a mixing coefficient immediately before the mixing coefficient MixGain(i) is calculated. That is, regarding each mixing coefficient whose value is not −∞ dB, a differential value between two consecutive mixing coefficients is calculated.

Specifically, for example, a process shown in FIG 7 is performed.

That is, an initial value of a predetermined parameter t is set to t=1. Then, the parameter t is increased by an increment of 1 while t<i is satisfied and a mixing coefficient MixGain (i−t) having the (i−t)th transferring order is −∞ dB. Note that the transferring order (i−t) is in the same class as the transferring order i.

When the parameter t does not satisfy at least one of conditions t<i and MixGain(i−t) −∞ dB and in the case where the parameter t=i is satisfied, a differential value MixGain(i)_diff(i) of the mixing coefficient MixGain(i) having the ith transferring order is a value of the mixing coefficient MixGain(i) itself.

On the contrary, in the case where the parameter t=i is not satisfied, a value obtained by subtracting the mixing coefficient MixGain(i−t) from the mixing coefficient MixGain(i) is the differential value MixGain(i)_diff(i) of the mixing coefficient MixGain(i).

As described above, in the case where the differential value MixGain(i)_diff(i) of the mixing coefficient MixGain (i) is calculated, a difference between a mixing coefficient to be processed having the ith transferring order and a mixing coefficient having transferring order immediately before the lib transferring order is basically obtained.

Note that, in the case where a value of the mixing coefficient having the transferring order immediately before the transferring order of the ith mixing coefficient is −∞ dB, the (i−t)th mixing coefficient having a value which is not −∞ dB, having the transferring order closest to the ith, and satisfying t<i is a target to be used for calculating a difference.

In the case where a mixing coefficient having a value which is not −∞ dB does not exist even at the top position of a class to which the mixing coefficient to be processed belongs, the value of the mixing coefficient MixGain(i) itself is set as the differential value MixGain(i)_diff(i).

<Process STP4>

In the process STP4 subsequent to the process STP3, a process STP4(1) and a process STP4(2) are performed, and symmetry between mixing coefficients is determined.

That is, in the process STP4(1), it is determined whether or not the symmetry value syn(i) of the mixing coefficient MixGain(i) having the ith transferring order is 0 by referring to the symmetry table. In the case where the symmetry value syn(i) is not 0, it is determined that symmetry is used for encoding the mixing coefficient MixGain(i).

In the case where symmetry is used, it is further determined whether or not the mixing coefficient MixGain(i) and the mixing coefficient MixGain(syn(i)) have the same value. In the case where it is determined that the mixing coefficients have the same value, it is determined that the value of the mixing coefficient MixGain(i) is symmetric to that of the mixing coefficient MixGain(syn(i)). On the contrary, in the case where it is determined that the mixing coefficients do not have the same value, it is determined that the value of the mixing coefficient MixGain(i) is asymmetric to that of the mixing coefficient MixGain(syn(i)).

In the case where the symmetry value syn(i) of the mixing coefficient. MixGain(i) having the ith transferring order is 0, it is determined that symmetry is not used for encoding the mixing coefficient MixGain(i).

After the process STP4(1) is performed with respect to all the mixing coefficients MixGain(i), in the process STP4(2), it is determined whether or not all the mixing coefficients MixGain(i) whose symmetry is to be used at the time of encoding are symmetric to the mixing coefficient MixGain (syn(i)). That is, it is determined whether or not die mixing coefficients MixGain(i) whose symmetry is to be used includes even one mixing coefficient having a value asymmetric to the value of the mixing coefficient MixGain(syn (i)).

In the case where the mixing coefficients MixGain(i) whose symmetry is to be used includes no mixing coefficient having a value asymmetric to the value of the mixing coefficient MixGain(syn(i)), it is determined that all the mixing coefficients are symmetric and a flag all_gain_symmetric_flag=0 is set.

On the contrary, in the case where the mixing coefficients MixGain(i) whose symmetry is to be used includes even one mixing coefficient having a value asymmetric to the value of the mixing coefficient MixGain(syn(i)), it is determined that not all the mixing coefficients are symmetric and the flag all_gain_symmetric_flag=1 is set.

<Process STP5>

In the process STP5, fist, the flag all_gain_symmetric_flag of 1 bit indicating whether or not all the mixing coefficients are symmetric is written in a coefficient code string on the basis of a result of determination of symmetry in the process STP4. Then, a process STP5(1) and a process STP5(2) are performed.

In the case where all the mixing coefficients are symmetric, the process STP5(1) is performed.

In the process STP5(1), the mixing coefficient MixGain(i) whose symmetry is determined to be used has the same value as that of the mixing coefficient MixGain(syn(i)) and does not need to be transferred to the reproduction side, and therefore the mixing coefficient MixGain(i) is written with 0 bit in the coefficient code string. That is, nothing is written about the mixing coefficient MixGain(i) whose symmetry is determined to be used in the coefficient code string to be transferred to the reproduction side as an encoded mixing coefficient.

On the contrary, the mixing coefficient MixGain(i) whose symmetry is not determined to be used needs to be transferred to the reproduction side, and the mixing coefficient MixGain(i) is encoded in the process STP6 described below.

In the case where not all the mixing coefficients are symmetric, the process STP5(2) is performed.

In the process STP5(2), a flag Symmetry_info_flag(i) of 1 bit indicating whether or not the value of the mixing coefficient MixGain(i) whose symmetry is determined to be used is symmetric to the value of the mixing coefficient MixGain(syn(i)) is written in the coefficient code string. Herein, a value of the flag Symmetry_info_flag(i) is set to 0 in the case where the value of the mixing coefficient MixGain(i) is symmetric and is set to 1 in the case where the value of the mixing coefficient MixGain(i) is asymmetric.

Among the mixing coefficients MixGain(i) whose symmetry is to be used, the mixing coefficient MixGain(i) having a value symmetric to the value of the mixing coefficient MixGain(syn(i)) does not need to be transferred to the reproduction side. Therefore, nothing is written in the coefficient code string.

Meanwhile, among the mixing coefficients MixGain(i) whose symmetry is to be used, the mixing coefficient MixGain(i) having a value asymmetric to the value of the mixing coefficient MixGain(syn(i)) needs to be transferred to the reproduction side. Therefore, the mixing coefficient MixGain(i) is encoded in the process STP6.

Further, the mixing coefficient MixGain(i) whose symmetry is not determined to be used needs to be transferred to the reproduction side. Therefore, the mixing coefficient MixGain(i) is encoded in the process STP6.

<Process STP6>

The mixing coefficient MixGain(i) whose value is not symmetric and the mixing coefficient MixGain(i) whose symmetry is not to be used are encoded in the process STP6. In the process STP6, two processes, i.e., a process STP6(1) and a process STP6(2) are performed.

In the process STP6(1), the flag Minus_Inf_flag(i) of the mixing coefficient MixGain(i) to be processed is written in the coefficient code string with 1 bit.

Herein, in the case of the flag Minus_Inf_flag(i)=0, i.e., in the case where the value of the mixing coefficient MixGain (i) is −∞ dB, encoding of the mixing coefficient MixGain(i) is terminated.

Meanwhile, in the case of the flag Minus_Inf_flag(i)=1, i.e., in the case where the value of the mixing coefficient MixGain(i) is not −∞ dB, the process STP6(2) is performed.

In the process STP6(2), entropy encoding of the mixing coefficient MixGain(i) whose value is not −∞ dB is performed.

Specifically, in the case where the differential value MixGain(i)_diff(i) of the mixing coefficient MixGain(i) falls within a range set in advance, the differential value MixGain (i)_diff(i) is subjected to entropy encoding by a cord word set in advance and is written in the coefficient code string. On the contrary, in the case where the differential value MixGain(i)_diff(i) does not fall within the range set in advance, a code indicating that the differential value is out of the range set in advance and a code of Q bit(s) indicating the differential value MixGain(i)_diff(i) are written in the coefficient code string as cord words of the mixing coefficient MixGain(i) having the ith transferring order.

Note that, in the process STP6(2), the differential value MixGain(i)_diff(i) is subjected to entropy encoding, and, more specifically, in the case where the mixing coefficient MixGain(i) to be processed is a mixing coefficient positioned at the top of each class, a differential value cannot be obtained. Therefore, the mixing coefficient MixGain(i) itself is subjected to entropy encoding.

For example, in the case where the quantized resolution is 1 dB, the range of the mixing coefficient is 3 dB to −27 dB and −∞ dB, and the range set in advance is 4 dB to −6 dB, the differential value MixGain(i)_diff(i) may be subjected to entropy encoding with the use of a code table shown in FIG. 8.

Note that, in FIG 8, the "MixGain_diff" indicates a value of the differential value MixGain(i)_diff(i), the "CODE" indicates a code written in the coefficient code string. The "bit_length" is the number of bits of a code written in the coefficient code string.

In this example, a code indicating that a differential value is out of the range set in advance is set to 111, and the number of bits Q of the code indicating the differential value MixGain(i)_diff(i) is set to 5 bits.

In the case where the code table shown in FIG. 8 is used and, for example, the value of the differential value MixGain (i)_diff(i) is 4 dB, the cods "01111" is written in the coefficient code string as a value of the encoded mixing coefficient MixGain(i).

The process STP1 to the process STP6 described above are performed, and therefore each mixing coefficient is encoded and the coefficient code string is obtained.

<Header and Coefficient Code String>

The coefficient code string obtained as described above and a header added to a bit stream to be transmitted to the reproduction side are shown in, for example, FIG. 9 and FIG. 10.

That is, FIG. 9 shows syntax of a header.

In an example of FIG. 9, the header includes a flag DMX_coef_exist_flag Indicating whether or not a mixing coefficient is transferred. For example, the flag DMX_coef_exist_flag=1 indicates that the mixing coefficient is transferred, whereas the flag DMX_coef_exist_flag=0 indicates that the mixing coefficient is not transferred.

Number_of_mix_coef in the header indicates the number of types (sets) of mixing coefficients to be transferred. Spk_config_idx[idmx] indicates speaker arrangement on art output side of a set of the (idmx)th mixing coefficients. For example, is the case of the Spk_config_idx[idmx]−0, the speaker arrangement on he output side is 5 ch speaker arrangement.

Use_differential_coding_flag is a flag indicating whether or not the differential value MixGain(i)_diff(i) is encoded or the mixing coefficient MixGain(i) is encoded. For example, Use_differential_coding_flag=1 indicates that the differential value is encoded, and the above process STP3 is performed at the time of encoding. Meanwhile, Use_differential_coding_flag=0 indicates that the mixing coefficient is encoded, and the process STP3 is not performed at the time of encoding and the mixing coefficient itself is encoded.

Use_symmetry_information_flag is a flag indicating whether or not symmetry is used for encoding all the mixing coefficients, Use_symmetry_information_flag=1 indicates that, in the case where (lie mixing coefficients are encoded, symmetry is used as necessary. On the contrary, Use_symmetry_information_flag=0 indicates that symmetry is not used for encoding all the mixing coefficients.

Therefore, Use_differential_coding_flag is 1 and Use_symmetry_information_flag is 1 in this embodiment. Note that the mixing coefficients themselves may be encoded without calculating differential values between the mixing coefficients. Alternatively, encoding may be performed by calculating differential values but not using symmetry.

Quantization_level indicates a quantisation level in the header.

The header shown in FIG. 9 is added to the top of a bit stream to be transferred to the reproduction side.

FIG. 10 shows syntax of a coefficient code string. Note that Q11 to Q14 in FIG. 10 are mitten for explaining the coefficient code string and therefore are not written in an actual coefficient code string.

In the coefficient code string of FIG. 10, Mix_gain_changed_flag is a flag indicating whether or not mixing coefficients of a frame corresponding to the coefficient code string are the same as mixing coefficients of a frame immediately before the above frame, For example, in the case of Mix_gain_changed_flag=0, the mixing coefficients are the same between a current frame and a frame immediately before the current frame, and therefore the mixing coefficients are not transferred in the current frame. On the contrary, in the case of Mix_gain_changed_flag=1, the mixing coefficients are different between the current frame and the frame immediately before the current frame, and therefore the mixing coefficients are transferred in the current frame.

In the case where Use_symmetry_information_flag written in the header is 1, i.e., symmetry is used for encoding the mixing coefficients, information is written for each set of the mixing coefficients indicated by the index idmx as shown in the part Q11.

A flag all_gain_symmetric_flag[idmx] indicates whether or not all the mixing coefficients in the set of the mixing coefficients specified by the index idmx are symmetric. For example, all_gain_symmetric_flag[Mmx]=0 indicates that all the mixing coefficients are symmetric, and all_gain_symmetric_flag[idmx]=1 indicates that not all the mixing coefficients are symmetric. This flag all_gain_symmetric_flag [idmx] corresponds to the above flag all_gain_symmetric_flag.

Note that the set of the mixing coefficients specified by the index idmx is a set of M×N mixing coefficients MixGain (m,n) prepared for a pattern of a single mixing process.

As written in the part Q11, information of Symmetry_info_flag[idmx][i], Minus_Inf_flag[idmx][i], and MixGain_diff[idmx][i] are written in the coefficient code string for each of the M×N mixing coefficients as necessary.

Herein, Symmetry_info_flag[idmx][i] indicates whether or not the value of the mixing coefficient having the ith transferring order is symmetric. Specifically, in the case where the value of the mixing coefficient is symmetric, a value of Symmetry_info_flag[idmx][i] is set to 0, whereas, in the case where the value of the mixing coefficient is asymmetric, the value thereof is set to 1. This flag Symmetry_info_flag[idmx][i] corresponds to the above flag Symmetry_info_flag(i).

Minus_Inf_flag[idmx][i] indicates whether or not the value of the mixing coefficient having the ith transferring order is $-\infty$. For example, in the case where the value of the mixing coefficient is $-\infty$, a value of Minus_Inf_flag[idmx][i] is set to 0, whereas, in the case where the value of the mixing coefficient is not $-\infty$, the value thereof is set to 1. This flag Minus_Inf_flag[idmx][i] corresponds to the above flag Minus_Inf_flag(i).

MixGain_diff[idmx][i] indicates a cord word obtained by performing entropy encoding with respect to the mixing coefficient having the ith transferring order or a differential value of the mixing coefficient, such as a Huffman cord word.

Symmetry_info_tbl[Speaker_config_idx[idmx]][i] in the coefficient code string indicates a symmetry value of the mixing coefficient having the ith transferring order in the symmetry table.

For example, in the case of Use_symmetry_information_flag=1 and in the case where the symmetry value of the mixing coefficient MixGain(i) to be processed is not 0 and all_gain_symmetric_flag[idmx]=1 is satisfied, information is written in the coefficient code string as shown in the part Q12.

That is, first, Symmetry_info_flag[idmx][i] is written. Then, in the case where Symmetry_info_flag[idmx][i]=1 is written, Minus_Inf_flag[idmx][i] is further written. In the case where Minus_Inf_flag[idmx][i]=1 is written, MixGain_diff[idmx][i] is further written.

Meanwhile, in the case of Use_symmetry_information_flag=1 and in the ease where the symmetry value of the mixing coefficient MixGain(i) to be processed is 0, Minus_Inf_flag[idmx][i] is written in the coefficient code string as shown in the part Q13. Then, in the case where Minus_Inf_flag[idmx][i]=1 is written, MixGain_diff[idmx][i] is further written.

In the case where Use_symmetry_information_flag written in the header is 0, i.e., symmetry is not used for encoding the mixing coefficient, information on each of the M×N mixing coefficients is written for each set of mixing coefficients indicated by the index idmx as shown in the part Q14.

That is, first, Minus_Inf_flag[idmx][i] is written, and, in the case where 1 is written as a value of Minus_Inf_flag [idmx][i], MixGain_diff[idmx][i] is further written.

<Configuration Example of Encoding Device>

A specific embodiment to which the present technology is applied will be described.

Figure 11:
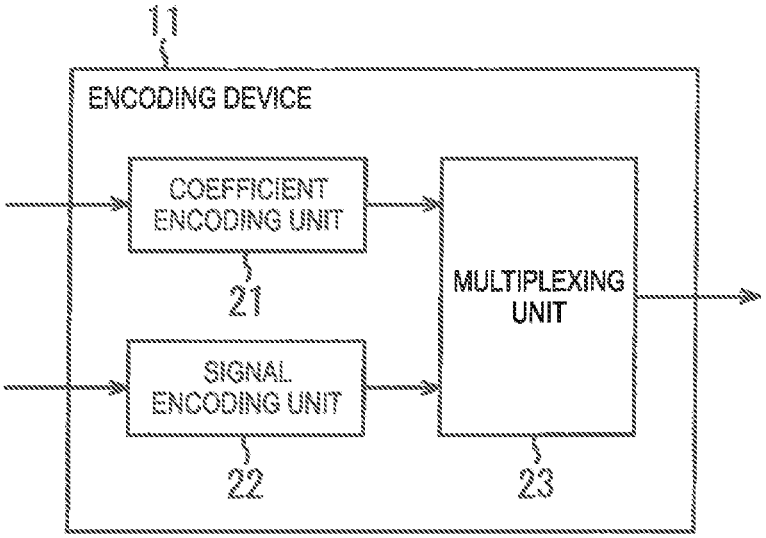
FIG. 11 shows a configuration example of an encoding device.

FIG. 11 shows a configuration example of an encoding device to which the present technology is applied.

An encoding device 11 in FIG. 11 includes a coefficient encoding unit 21, a signal encoding unit 22, and a multiplexing unit 23.

The input-side M sound source positions Source(m), the output-side N speaker arrangement positions Target(n), and the M×N mixing coefficients MixGain(m,n) are supplied to the coefficient encoding unit 21.

Note that, more specifically, the input-side sound source positions, the output-side speaker arrangement, and the mixing coefficients are supplied for each mixing process performed with respect to audio signals on the reproduction side. For example, in the case where the number N of the output-side speakers is changed, a different mixing process is performed, and therefore information indicating speaker arrangement and mixing coefficients are necessary for each mixing process.

The coefficient encoding unit 21 encodes the supplied mixing coefficients on the basis of the supplied input-side sound source positions and the supplied output-side speaker arrangement and supplies a coefficient code string obtained as a result of the encoding to the multiplexing unit 23.

The signal encoding unit 22 encodes supplied audio signals with a predetermined encoding technique and supplies a signal code string obtained as a result of the encoding to the multiplexing unit 23. The multiplexing unit 23 multiplexes the coefficient code string supplied from the coefficient encoding unit 21 and the signal code string supplied from the signal encoding unit 22 and outputs an output code string obtained as a result of the multiplexing.

<Configuration Example of Coefficient Encoding Unit>

Figure 12:
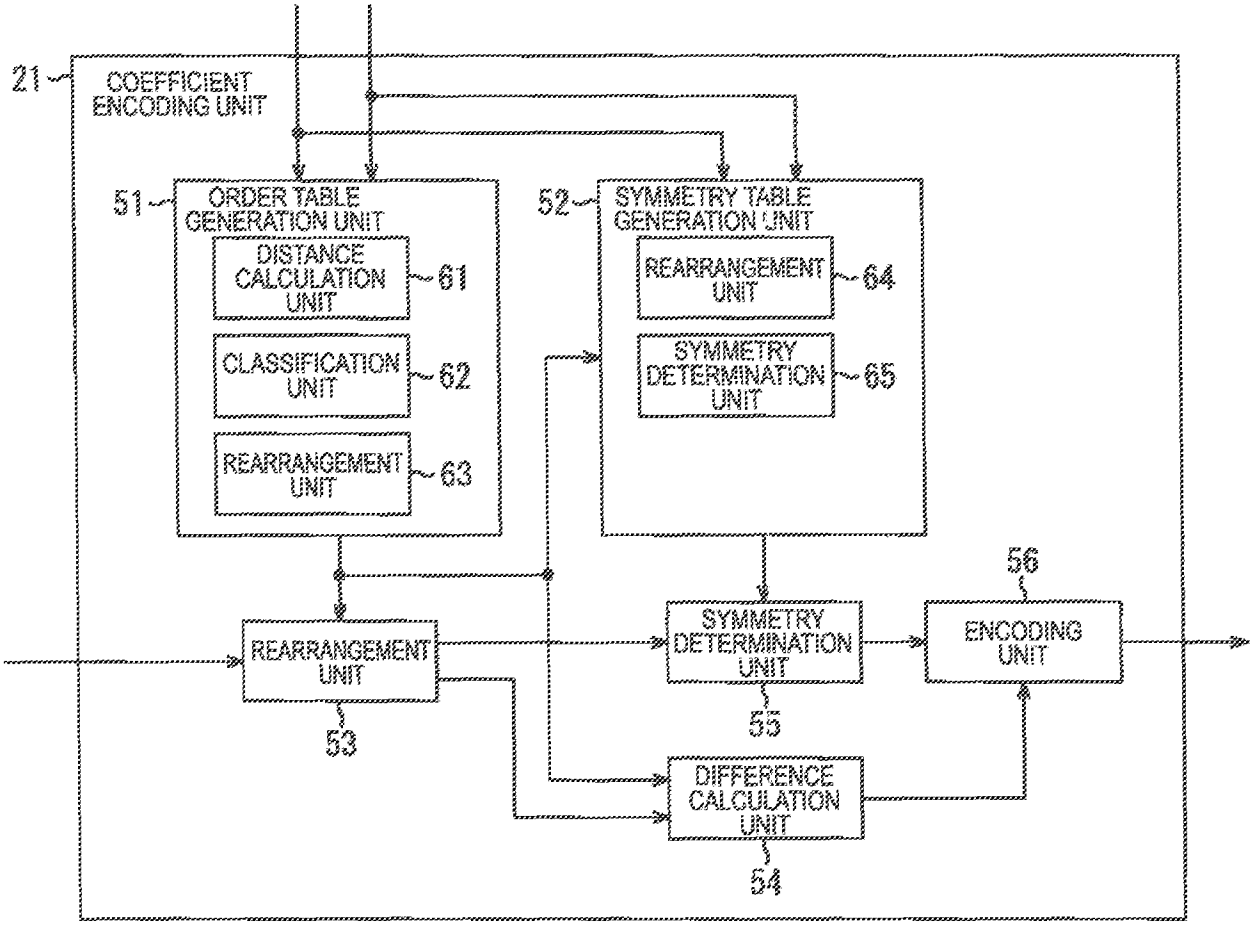
FIG. 12 shows a configuration example of a coefficient encoding unit.

The coefficient encoding unit 21 is configured as shown in, for example, FIG. 12.

The coefficient encoding unit 21 includes an order table generation unit 51, a symmetry table generation unit 52, a rearrangement unit 53, a difference calculation unit 54, a symmetry determination unit 55, and an encoding unit 56.

The order table generation unit 51 generates a transferring order table on the basis of supplied input-side sound source positions and supplied output-side speaker arrangement, and supplies the transferring order table to the symmetry table generation unit 52, the rearrangement unit 53, and the difference calculation unit 54. The order table generation unit 51 includes a distance calculation unit 61, a classification unit 62, and a rearrangement unit 63.

The distance calculation unit 61 calculates the distances Dist(m,n) between the sound source positions Source(m) and the speaker positions Target(n). The classification unit 62 classifies the M×N mixing coefficients MixGain(m,n) into classes. The rearrangement unit 63 rearranges the mixing coefficients in each class on the basis of the distances Dist(m,n) and generates the transferring order table.

The symmetry table generation unit 52 generates a symmetry table on the basis of the supplied input-side sound source positions, the supplied output-side speaker arrangement, and the transferring order table from the order table generation unit 51 and supplies the symmetry table to the symmetry determination unit 55. The symmetry table generation unit 52 includes a rearrangement unit 64 and a symmetry determination unit 65.

The rearrangement unit 64 rearranges the mixing coefficients to be processed in accordance with the transferring order shown in the transferring order table supplied from the order table generation unit 51. The symmetry determination unit 65 determines, for each mixing coefficient, whether or not a mixing coefficient having a symmetric positional relationship with the mixing coefficient exists, i.e., whether or not there are mixing coefficients whose sound source positions have a symmetric positional relationship and speaker arrangement positions also have a symmetric positional relationship, and generates the symmetry table.

The rearrangement unit 53 rearranges the supplied mixing coefficients MixGain(m,n) in the transferring order shown in the transferring order table supplied from the order table generation unit 51 and supplies the rearranged mixing coefficients to the difference calculation unit 54 and the symmetry determination unit 55.

The difference calculation unit 54 calculates differential values between the mixing coefficients supplied from the rearrangement unit 53 with the use of the transferring order table supplied from the order table generation unit 51 and supplies the differential values to the encoding unit 56. The symmetry determination unit 55 determines symmetry between the values of the respective mixing coefficients on the basis of the symmetry table supplied from the symmetry table generation unit 52 and the mixing coefficients supplied from the rearrangement unit 53 and supplies a determination result thereof to the encoding unit 56.

The encoding unit 56 encodes the differential values supplied from the difference calculation unit 54 on the basis of the determination result supplied from the symmetry determination unit 55 and supplies a coefficient code string obtained as a result of the encoding to the multiplexing unit 23.

<Explanation for Encoding Process>

An encoding process performed by the encoding device 11 will be described with reference to a flowchart of FIG. 13. Note that the encoding process is performed for each frame of audio signals.

In Step S11, the signal encoding unit 22 encodes supplied audio signals and supplies a signal code string obtained as a result of the encoding to the multiplexing unit 23.

In Step S12, the coefficient encoding unit 21 performs a coefficient encoding process to encode mixing coefficients and supplies a coefficient code string obtained as a result of the encoding to the multiplexing unit 23. Note that details of the coefficient encoding process will be described below. In the coefficient code string, a set of mixing coefficients for use in a mixing process of each pattern is encoded and written.

In Step S13, the multiplexing unit 23 multiplexes the coefficient code string supplied from the coefficient encoding unit 21 and the signal code string supplied from the signal encoding unit 22 and outputs an output code string obtained as a result of the multiplexing. Then, the encoding process is terminated.

As described above, the encoding device 11 encodes the mixing coefficients and multiplexes the coefficient code string obtained as a result of the encoding and the signal code string, thereby obtaining the output code string. Thus, on an output side of the output code string in the encoding device 11, it is possible to specify a free mixing coefficient and transfer the free mixing coefficient to the reproduction side. Therefore, on the reproduction side, it is possible to perform a mixing process suitable for a content and a reproduction environment. This makes it possible to obtain higher quality audio.

<Explanation for Coefficient Encoding Process>

A coefficient encoding process corresponding to the process of Step S12 in FIG. 13 will be described with reference to flowcharts of FIG. 14 and FIG. 15.

In Step S41, the order table generation unit 51 generates a transferring order table on the basis of supplied input-side sound source positions and supplied output-side speaker arrangement, and supplies the transferring order table to the symmetry table generation unit 52, the rearrangement unit 53, and the difference calculation unit 54.

That is, the distance calculation unit 61 calculates the distances Dist(m,n) between the sound source positions Source(m) and the speaker positions Target(n) by performing the above process STP1(1), i.e., calculating the equation (2). The classification unit 62 classifies the M×N mixing coefficients MixGain(m,n) by performing the process STP1 (2). Then, the rearrangement unit 63 generates the transferring order table by performing the process STP1(3) and the process STP1(4). That is, the mixing coefficients in each class are rearranged on the basis of the distances Dist(m,n), and the transferring order table is generated so that the mixing coefficients belonging to each class are transferred in the rearranged order.

In Step S42, the symmetry table generation unit 52 generates a symmetry table on the basis of the supplied input-side sound source positions, the supplied output-side speaker arrangement and the transferring order table from the order table generation unit 51 and supplies the symmetry table to the symmetry determination unit 55.

That is, the rearrangement unit 64 changes arrangement order of the mixing coefficients to be processed in accordance with the transferring order shown in the transferring order table supplied from the order table generation unit 51. Thus, the mixing coefficients MixGain(i) in the transferring order i shown in, for example, FIG. 6 are determined.

The symmetry determination unit 65 generates the symmetry table by detecting a symmetric mixing coefficient MixGain(i') having a symmetric positional relationship with each mixing coefficient MixGain(i) having the transferring order i and writing the symmetry value syn(i) indicating a detection result thereof in the symmetry table.

Note that the processes of Step S41 and Step S42 do not necessarily need to be performed in each frame and may be performed as appropriate if necessary. The transferring order table and the symmetry table are generated for each pattern of a mixing process, i.e., for each set of the mixing coefficients specified by the index idmx in FIG. 10.

When the transferring order table and the symmetry table are generated for each set of the mixing coefficients, the coefficient encoding unit 21 selects a set of mixing coefficients to be processed and performs processing described below.

In Step S43, among the supplied mixing coefficients, the rearrangement unit 53 rearranges a set of fee mixing coefficients MixGain(m,n) to be processed in the transferring order shown in the transferring order table supplied from the order table generation unit 51 and supplies the rearranged mixing coefficients to the difference calculation unit 54 and the symmetry determination unit 55. That is, the above process STP3(1) is performed.

In Step S44, the difference calculation unit 54 calculates differential values between the mixing coefficients supplied from the rearrangement unit 53.

Specifically, first, the difference calculation unit 54 performs the process STP3(2) to generate the flag Minus_Inf_flag(i) of the mixing coefficients MixGain(i) and supplies the flag Minus_Inf_flag(i) to the encoding unit 56.

Further, the difference calculation unit 54 performs the process STP3(3) with respect to the mixing coefficients MixGain(i) having the flag Minus_Inf_flag(i)=1 with reference to the transferring order table supplied from the order table generation unit 51, thereby calculating the differential values MixGain(i)_diff(i). The difference calculation unit 54 supplies the calculated differential values MixGain(i)_diff(i) to the encoding unit 56. Note that, as to the mixing coefficient MixGain(i) positioned at the top of each class, the difference calculation unit 54 supplies the mixing coefficient MixGain(i) itself to the encoding unit 56 without calculating a differential value thereof. In other words, the mixing coefficient MixGain(i) itself is used as the differential value MixGain(i)_diff(i).

In Step S45, the symmetry determination unit 55 determines symmetry between the values of the respective mixing coefficients on the basis of the symmetry table supplied from the symmetry table generation unit 52 and the mixing coefficients supplied from the rearrangement unit 53 and supplies a determination result thereof to the encoding unit 56.

Specifically, fee symmetry determination unit 55 performs she process STP4(1) to determine whether or not symmetry is used for encoding the mixing coefficients MixGain(i) and supplies a determination result thereof to the encoding unit 56. Further, the symmetry determination unit 55 performs the process STP4(2) on the basis of the mixing coefficients from the rearrangement unit 53 and the symmetry table from the symmetry table generation unit 52 to thereby generate the flag all_gain_symmetric_flag and supplies the flag all_gain_symmetric_flag to the encoding unit 56.

Further, in the case of the flag all_gain_symmetric_flag=1, the symmetry determination unit 55 generates the flag Symmetry_info_flag(i) of the mixing coefficient whose symmetry is to be used and supplies the flag Symmetry_info_flag(i) to the encoding unit 56.

In Step S46, the encoding unit 56 determines whether or not all the mixing coefficients are symmetric on the basis of the flag all_gain_symmetric_flag supplied from the symmetry determination unit 55. For example, in the case of the flag all_gain_symmetric_flag=0, it is determined that all the mixing coefficients are symmetric.

In the case where it is determined that all the mixing coefficients are symmetric in Step S46, the encoding unit 56 writes the Sag all_gain_symmetric_flag=0 in the coefficient code string in Step S47. That is, in the example shown in FIG. 10, all_gain_symmetric_flag[idmx]=0 is written.

In Step S48, the encoding unit 56 selects a single mixing coefficient MixGain(i) to be processed. For example, unprocessed mixing coefficients are selected one by one in the ascending transferring order from the mixing coefficient MixGain(1) to the mixing coefficient having the last transferring order.

In Step S49, the encoding unit 56 determines whether or not symmetry is used for encoding the mixing coefficient MixGain(i) to be processed on the basis of the determination result supplied from the symmetry determination unit 55.

In the case where it is determined that symmetry is used in Step S49, the mixing coefficient to be processed is not subjected to entropy encoding, and therefore nothing is written in the coefficient code string, and the processing proceeds to Step S53.

On the contrary, in the case where it is determined that symmetry is not used in Step S49, in Step S50, the encoding unit 56 writes, in the coefficient code string, the flag Minus_Inf_flag(i) of the mixing coefficient MixGain(i) to be processed which is supplied from the difference calculation unit 54. That is, in the example of FIG. 10, Minus_Inf_flag[idmx][i] is written.

In Step S51, the encoding unit 56 determines whether or not the value of the flag Minus_Inf_flag(i) of the mixing coefficient to be processed is 0.

In the case where the value of the flag Minus_Inf_flag(i) is 0 in Step S51, i.e., the value of the mixing coefficient to be processed is $-\infty$ dB, the mixing coefficient to be processed is not subjected to entropy encoding, and the processing proceeds to Step S53.

Meanwhile, in the ease where the value of the flag Minus_Inf_flag(i) is 1 in Step S51, i.e., the value of the mixing coefficient to be processed is not $-\infty$ dB a process of Step S52 is performed.

In Step S52, the encoding unit 56 performs the process STP6(2) to perform entropy encoding with respect to the differential value MixGain(i)_diff(i) of the mixing coefficient to be processed which is supplied from the difference calculation unit 54 and writes a code obtained as a result of the encoding in the coefficient code string. After the entropy encoding is performed, the processing proceeds to Step S53.

In the ease where the entropy encoding is performed in Step S52, it is determined that symmetry is used in Step S49, or it is determined that the value of the flag Minus_Inf_flag(i) is 0 in Step S51, a process of Step S53 is performed.

In Step S53, the encoding unit 56 determines whether or not all mixing coefficients have been processed. That is, it is determined whether or not all the mixing coefficients have been encoded as mixing coefficients to be processed.

In the ease where it is determined that not all the mixing coefficients have been processed in Step S5S, the processing returns to Step S45 and the above processing is repeated. On the contrary, in the case where it is determined that all the mixing coefficients have been processed in Step S53, the processing proceeds to Step S63.

In the case where it is determined that not all the mixing coefficients are symmetric in Step S46, in Step S54, the encoding unit 56 writes the flag all_gain_symmetric_flag=1 in the coefficient code string.

In Step S55, the encoding unit 56 selects a single mixing coefficient MixGain(i) to be processed.

In Step S56, the encoding unit 56 determines whether or not symmetry is used for encoding the mixing coefficient MixGain(i) to be processed on the basis of the determination result supplied from the symmetry determination unit 55.

In the case where it is determined that symmetry is not used in Step S56, the processing proceeds to Step S59.

On the contrary, in the ease where it is determined that symmetry is used in Step S56, in Step S57, the encoding unit 56 writes whether or not the value of the mixing coefficient to be processed is symmetric in the coefficient code string. That is, the encoding unit 56 writes, in the coefficient code string, the flag Symmetry_info_flag(i) of the mixing coefficient to be processed which is supplied from the symmetry determination unit 55. For example, in the example of FIG. 10, the Symmetry_info_flag[idmx][i] is written.

In Step S58, the encoding unit 56 determines whether or not the value of the mixing coefficient to be processed is symmetric. For example, in the case of the flag Symmetry_info_flag(i)=0, it is determined that the value of the mixing coefficient is symmetric.

In the case where it is determined that the value of the mixing coefficient is symmetric in Step S58, the mixing coefficient to be processed is not subjected to entropy encoding, and the processing proceeds to Step S62.

On the contrary, in the case where it is determined that the value of the mixing coefficient is not symmetric in Step S58, the processing proceeds to Step S59.

In the case where it is determined that the value of the mixing coefficient is not symmetric in Step S58 or it is determined that, symmetry is not used in Step S56, a process of Step S59 is performed.

In Step S59, the encoding unit 56 writes, in the coefficient code string, the flag Minus_Inf_flag(i) of the mixing coefficient MixGain(i) to be processed which is supplied from the difference calculation unit 54.

In Step S60, the encoding unit 56 determines whether or not the value of the flag Minus_Inf_flag(i) of the mixing coefficient to be processed is 0.

In the case where the value of the flag Minus_Inf_flag(i) is 0 in Step S60, i.e., the value of the misting coefficient to be processed is −∞ dB, the mixing coefficient to be processed is not subjected to entropy encoding, and the processing proceeds to Step S62.

Meanwhile, in the case where the value of the flag Minus_Inf_flag(i) is 1 in Step S60, i.e., the value of the mixing coefficient to be processed is not −∞ dB, a process of Step S61 is performed.

In Step S61, the encoding unit 56 performs the process STP6(2) to perform entropy encoding with respect to the differential value MixGain(i)_diff(i) of the mixing coefficient to be processed which is supplied from the difference calculation unit 54 and writes a code obtained as a result of the encoding in the coefficient code string. After the entropy encoding is performed, the processing proceeds to Step S62.

In the case where the entropy encoding is performed in Step S61, it is determined that the value of the mixing coefficient is symmetric in Step S58, or it is determined that the value of the flag Minus_Inf_flag(i) is 0 in Step S60, a process of Step S62 is performed.

In Step S62, the encoding unit 56 determines whether or not all the mixing coefficients have been processed.

In the case where it is determined that, not all the mixing coefficients have been processed in Step S62, the processing returns to Step S55 and the above processing is repeated.

On the contrary, in the ease where it is determined that all the mixing coefficients have been processed in Step S62, the processing proceeds to Step S63.

In the case where it is determined that all the mixing coefficients have been processed is Step S53 or it is determined that all the mixing coefficients have been processed in Step S62, a process of Step S63 is performed.

In Step S63, the coefficient encoding unit 21 determines whether or not all the sets of mixing coefficients have been processed as the mixing coefficients to be processed. For example, in the case where all the sets of mixing coefficients have been processed as the mixing coefficients to be processed, it is determined that all the sets have been processed.

In the case where it is determined that not all the sets have been processed in Step S63> the processing returns to Step S43 and the above processing is repeated.

On the contrary, in tire case where it is determined that all the sets have been processed in Step S63, the encoding unit 56 supplies the obtained coefficient code string to the multiplexing unit 23. Thus, the coefficient encoding process is terminated.

Figure 13:
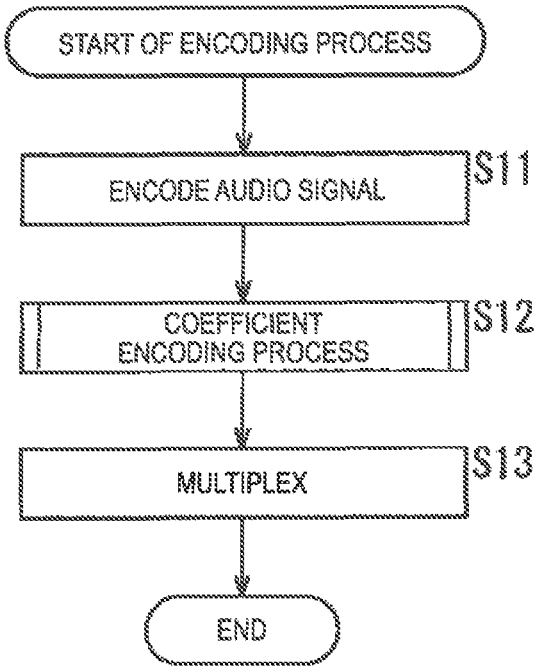
FIG. 13 is a flowchart showing an encoding process.

After the coefficient encoding process is terminated, the processing proceeds to Step S13 in FIG. 13.

As described above, the coefficient encoding unit 21 rearranges the transferring order of the mixing coefficients on the basis of the positional relationship between the sound source positions Source(m) and the speaker positions Target (n), i.e., the distances between the sound source positions and the speaker positions and calculates the differential values between the mixing coefficients in accordance with the transferring order, thereby encoding the differential values. Further, the coefficient encoding unit 21 encodes the mixing coefficients by using a positional relationship between the sound source positions and a positional relationship between the speaker arrangement positions, i.e., by using symmetry between the mixing coefficients.

As described above, when the transferring order of the mixing coefficients are rearranged on the basis of the distances between the sound source positions and the speaker positions and then the differential values between the mixing coefficients are calculated, the differential values can be further reduced, and therefore the mixing coefficients can be efficiently encoded. This makes it possible to further reduce a code amount (the number of bits) of the coefficient code string, and it is possible to obtain higher quality audio with a less code amount on the reproduction side. It is also possible to further reduce the code amount of the coefficient code string by performing encoding with the use of symmetry between the mixing coefficients.

<Configuration Example of Decoding Device>

A decoding device that inputs fee output code string output from the encoding device 11 as an input code string and decodes the input code string will be described.

Figure 16:
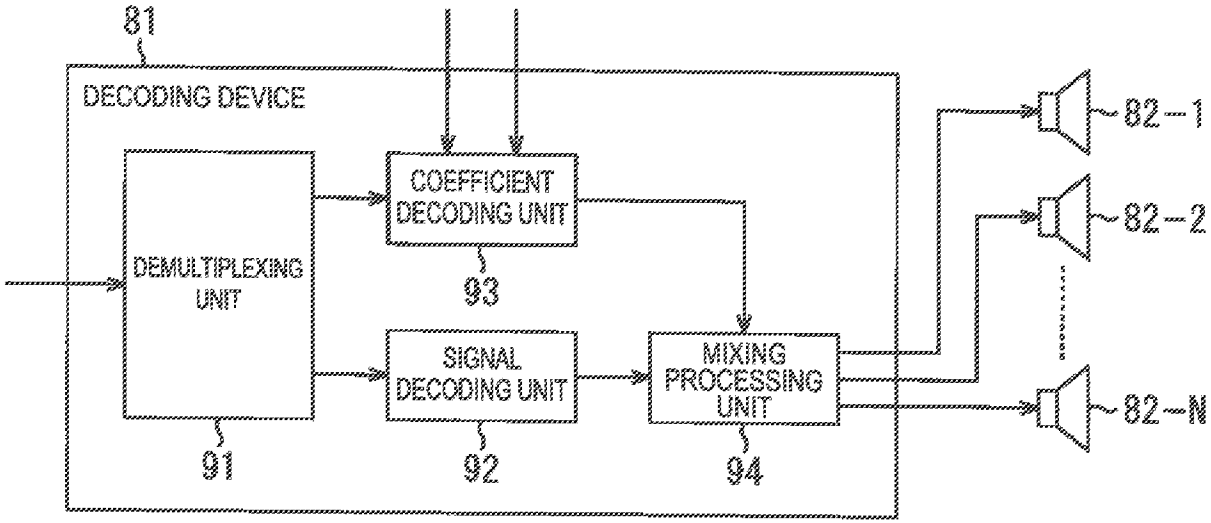
FIG. 16 shows a configuration example of a decoding device.

The decoding device is configured as shown in, for example, FIG. 16.

A decoding device 81 shown in FIG. 16 receives the output code string transmitted from the encoding device 11 as an input code string, decodes the input code string, and performs a mixing process with respect to audio signals obtained as a result of the decoding, thereby supplying the audio signals to a speaker 82-1 to a speaker 82-N to cause audio to be output.

Note that, hereinafter, in the case where it is unnecessary to distinguish the speaker 82-1 to the speaker 82-N in particular, those speakers will also be simply referred to as "speaker 82". The speaker 82-1 to the speaker 82-N are arranged in the speaker position Target(1) to the speaker position Target(N), respectively.

The decoding device 81 includes a demultiplexing unit 91, a signal decoding unit 92, a coefficient decoding unit 93, and a mixing process unit 94.

The demultiplexing unit 91 demultiplexes the received input code string into a signal code string and a coefficient code string and supplies the signal code string to the signal decoding unit 92 while supplying the coefficient code string to the coefficient decoding unit 93.

The signal decoding unit 92 decodes the signal code string supplied from the demultiplexing unit 91 and supplies audio signals of the M channels obtained as a result of the decoding, i.e., audio signals for the M sound source positions Source(m) to the mixing process unit 94.

The coefficient decoding unit 93 decodes the coefficient code string supplied from, the demultiplexing unit 91 with the use of supplied input-side sound source positions and supplied output-side speaker arrangement and supplies mixing coefficients obtained as a result of the decoding to the mixing process unit 94.

The mixing process unit 94 performs a mixing process with respect to the audio signals supplied from the signal decoding unit 92 with the use of the mixing coefficient supplied from the coefficient decoding unit 93 and converts the audio signals of M channels into audio signals of N channels. The mixing process unit 94 supplies the audio signals of the respective channels obtained by the mixing process to the speakers 82 corresponding to the respective channels and causes the speakers 82 to reproduce the audio signals. The speakers 82 reproduce the audio signals supplied from the mixing process unit 94 to thereby output audio.

<Configuration Example of Coefficient Decoding Unit>

Figure 17:
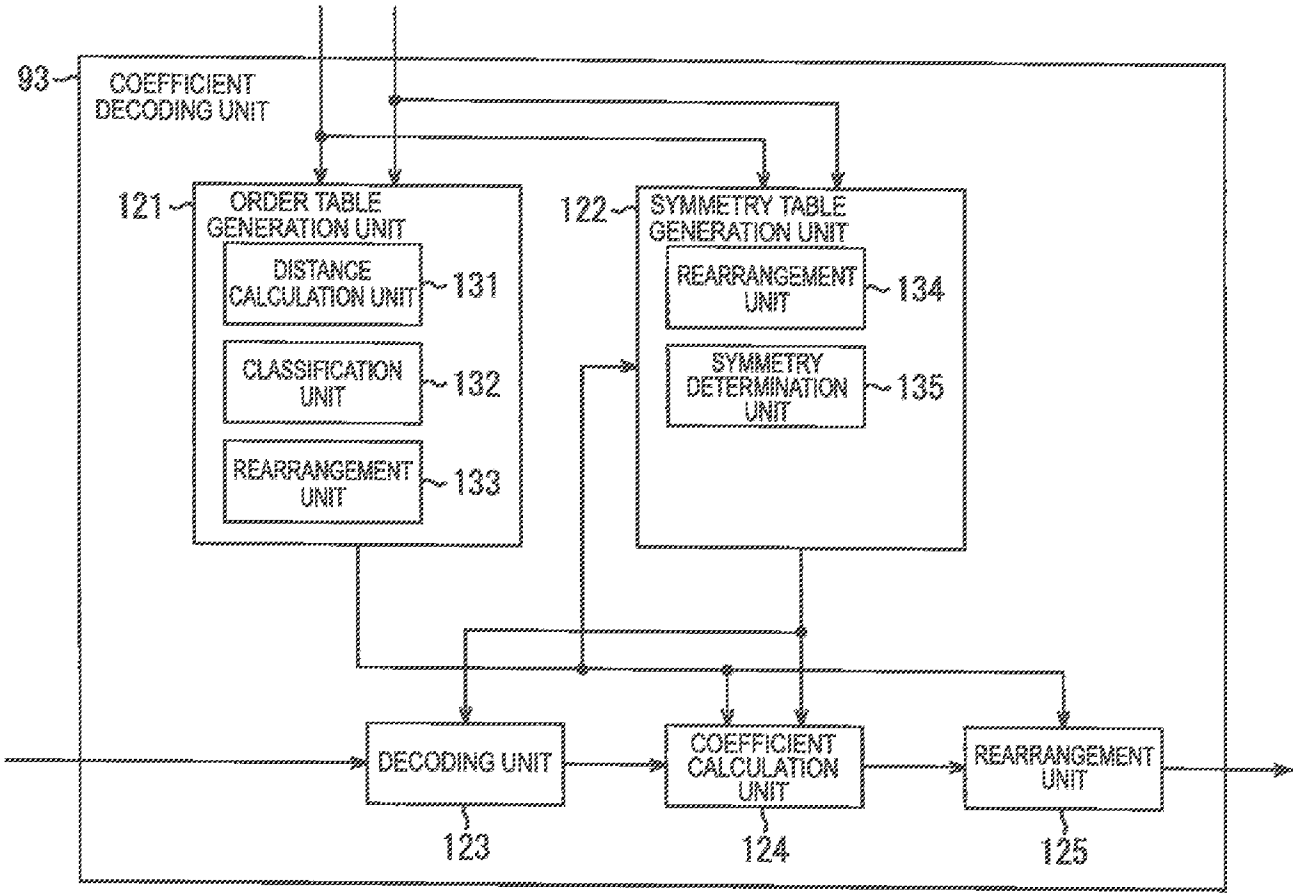
FIG. 17 shows a configuration example of a coefficient decoding unit.

The coefficient decoding unit 93 of the decoding device 81 is configured as shown in, for example, FIG. 17.

The coefficient decoding unit 93 shown in FIG. 17 includes m order table generation unit 121, a symmetry table generation unit 122, a decoding unit 123, a coefficient calculation unit 124, and the rearrangement unit 125.

The order table generation unit 121 generates a transferring order table on the basis of supplied input-side sound source positions and supplied output-side speaker arrangement, and supplies the transferring order table to the symmetry table generation unit 122, the coefficient calculation unit 124, and the rearrangement unit 125. The order table generation unit 121 includes a distance calculation unit 131, a classification unit 132, and a rearrangement unit 133. Note that the distance calculation unit 131 to the rearrangement unit 133 are similar to the distance calculation unit 61 to the rearrangement unit 63 in FIG. 12, and therefore description thereof is omitted.

Use symmetry table generation unit 122 generates a symmetry table on the basis of the supplied input-side sound source positions, the supplied output-side speaker arrangement, and the transferring order table from the order table generation unit 121 and supplies the symmetry table to the decoding unit 123 and tire coefficient calculation unit 124. The symmetry table generation unit 122 includes a rearrangement unit 134 and a symmetry determination unit 135. Note that the rearrangement unit 134 and the symmetry determination unit 135 are similar to the rearrangement unit 64 and the symmetry determination unit 65 in FIG. 12, and therefore description thereof is omitted.

The decoding unit 123 acquires the coefficient code string from the demultiplexing unit 91 on the basis of the symmetry table supplied from the symmetry table generation unit 122 and decodes the coefficient code string, thereby supplying the differential values MixGain(i)_diff(i) and the like obtained as a result of the decoding to the coefficient calculation unit 124.

The coefficient calculation unit 124 calculates mixing coefficients on the basis of the transferring order table from the order table generation unit 121, the symmetry table from the symmetry table generation unit 122, and the differential values and the like from the decoding unit 123 and supplies the calculated mixing coefficients to the rearrangement unit 125.

The rearrangement unit 125 rearranges the mixing coefficients supplied from the coefficient calculation unit 124 in appropriate order on the basis of the transferring order table from the order table generation unit 121 and supplies the rearranged mixing coefficients to the mixing process unit 94.

<Explanation for Decoding Process>

Figure 18:
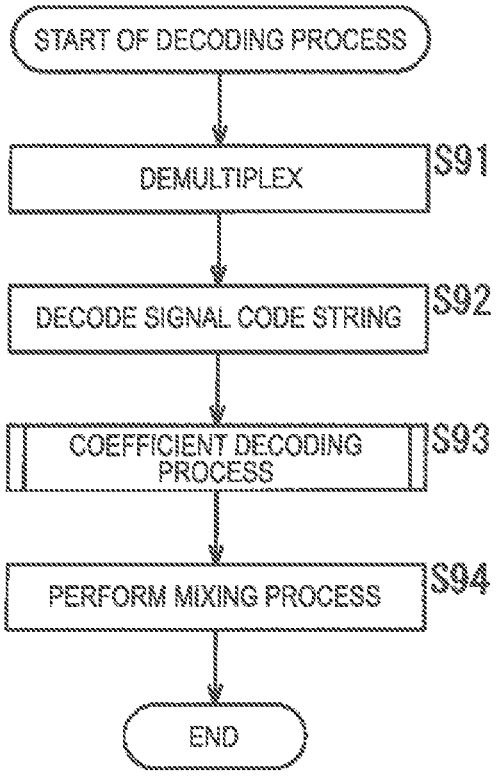
FIG. 18 is a flowchart showing a decoding process.

Herein, a decoding process performed by the decoding devise 81 will be described with reference to a flowchart of FIG. 18.

In Step S91, the demultiplexing unit 91 demultiplexes an input, code string and supplies a signal code string to the signal decoding unit 92 while supplying a coefficient code string to the coefficient decoding unit 93.

In Step S92, the signal decoding unit 92 decodes the signal code string supplied from the demultiplexing unit 91 and supplies audio signals obtained as a result of the decoding to the mixing process unit 94.

In Step S93, the coefficient decoding unit 93 performs a coefficient decoding process to decode the coefficient code string supplied from the demultiplexing unit 91 and supplies mixing coefficients obtained as a result of the decoding to the mixing process unit 94. Note that details of the coefficient decoding process will be described below.

In Step S94, the mixing process unit 94 performs mixing process with respect to the audio signals supplied from the signal decoding unit 92 with the use of the mixing coefficients supplied from the coefficient decoding unit 93 and supplies audio signals obtained as a result of the process to the speakers 82.

Specifically, the mixing process unit 94 generates an audio signal of a single channel corresponding to the speaker 82 arranged in the speaker position Target(n) by multiplying the mixing coefficient MixGain(m,n) by an audio signal for each sound source position Source(m) and adding the audio signal multiplied by the mixing coefficient. The mixing process unit 94 generates audio signals of the N channels corresponding to the N speakers 82 and supplies the audio signals to the speakers 82.

The speakers 82 output audio on the basis of the audio signals supplied from the mixing process unit 94. When audio is output from the speakers 82, the decoding process is terminated.

In this way, the decoding device 81 decodes the coefficient code string and performs the mixing process with respect to the audio signals with the use of the mixing coefficients obtained as a result of the decoding. The decoding device 81 decodes the mixing coefficients that have been efficiently encoded by calculating the differential values on the basis of the distances between the sound source positions and the speaker positions or by using symmetry between the mixing coefficients. Therefore, it is possible to obtain higher quality audio with a less code amount.

<Explanation for Coefficient Decoding Process>

Figure 19:
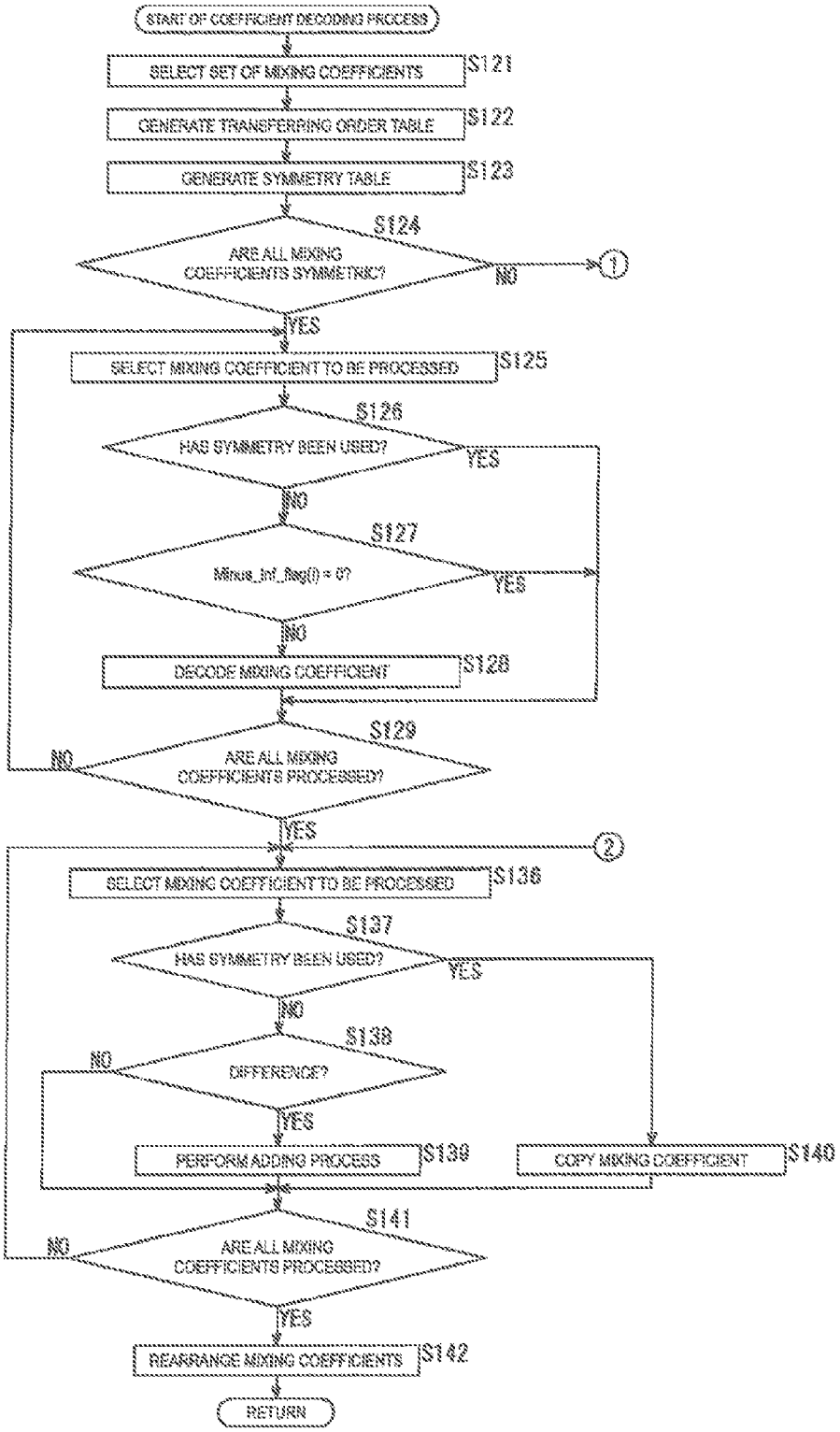
FIG. 19 is a flowchart showing a coefficient decoding process.
Figure 20:
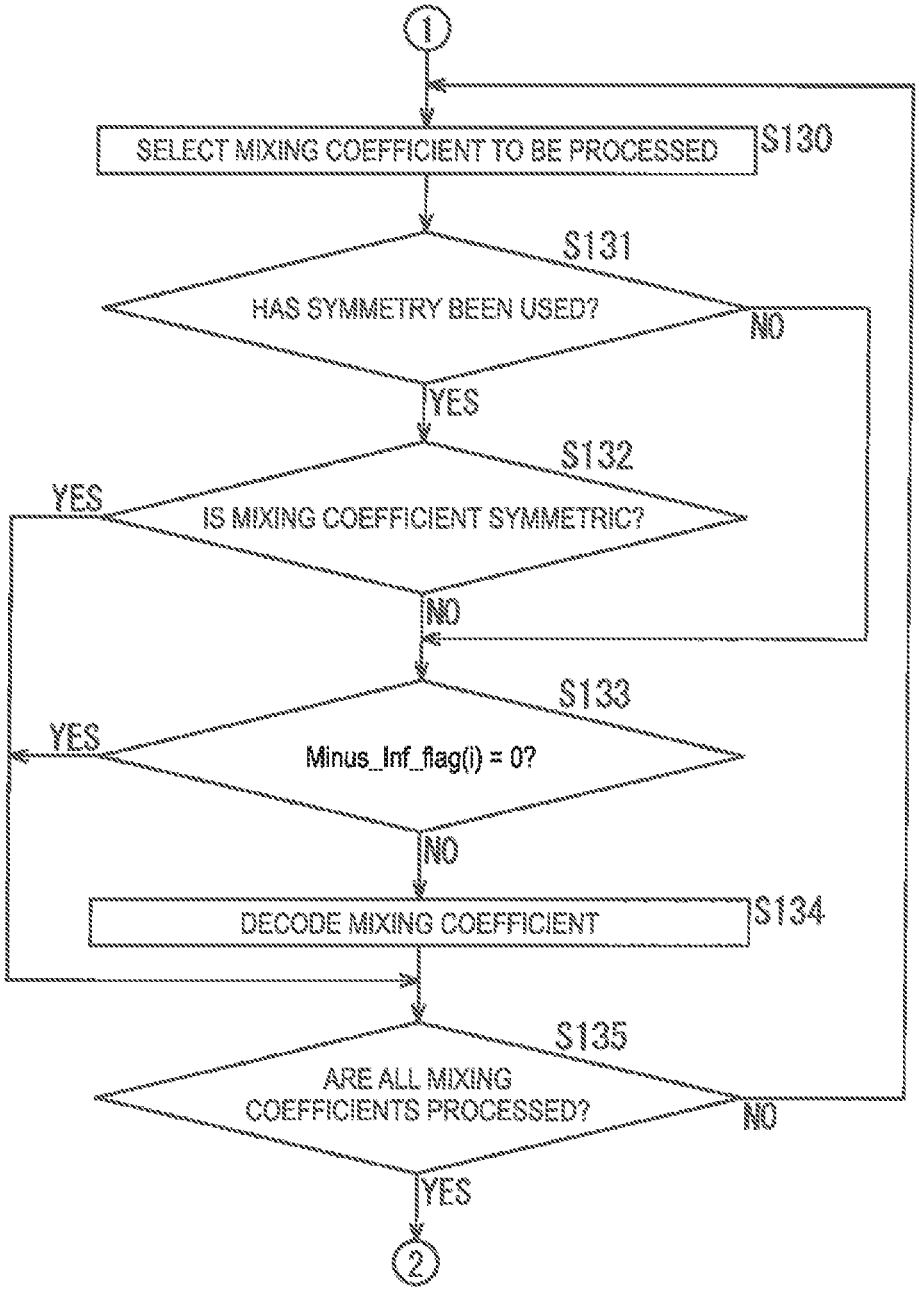
FIG. 20 is a flowchart showing a coefficient decoding process.

A coefficient decoding process corresponding to the process of Step S93 in FIG. 18 will be described with reference to flowcharts in FIG. 19 and FIG. 20.

In Step S121, the coefficient decoding unit 93 selects, on the basis of information supplied from a host control device or the like (not shown) as appropriate, a set of mixing coefficients determined by a combination of sound source positions of audio signals to be subjected to a mixing process and arrangement positions of the speakers 82.

That is, for example, a single set of mixing coefficients specified by the index idmx in FIG. 10 is selected and fee set of the mixing coefficients is processed as mixing coefficients to fee processed hereinafter. That is, information on the mixing coefficients constituting the set to be processed is read from the coefficient code string.

After the set of the mixing coefficients to be processed is selected, processes of Step S122 and Step S123 are performed.

Figure 14:
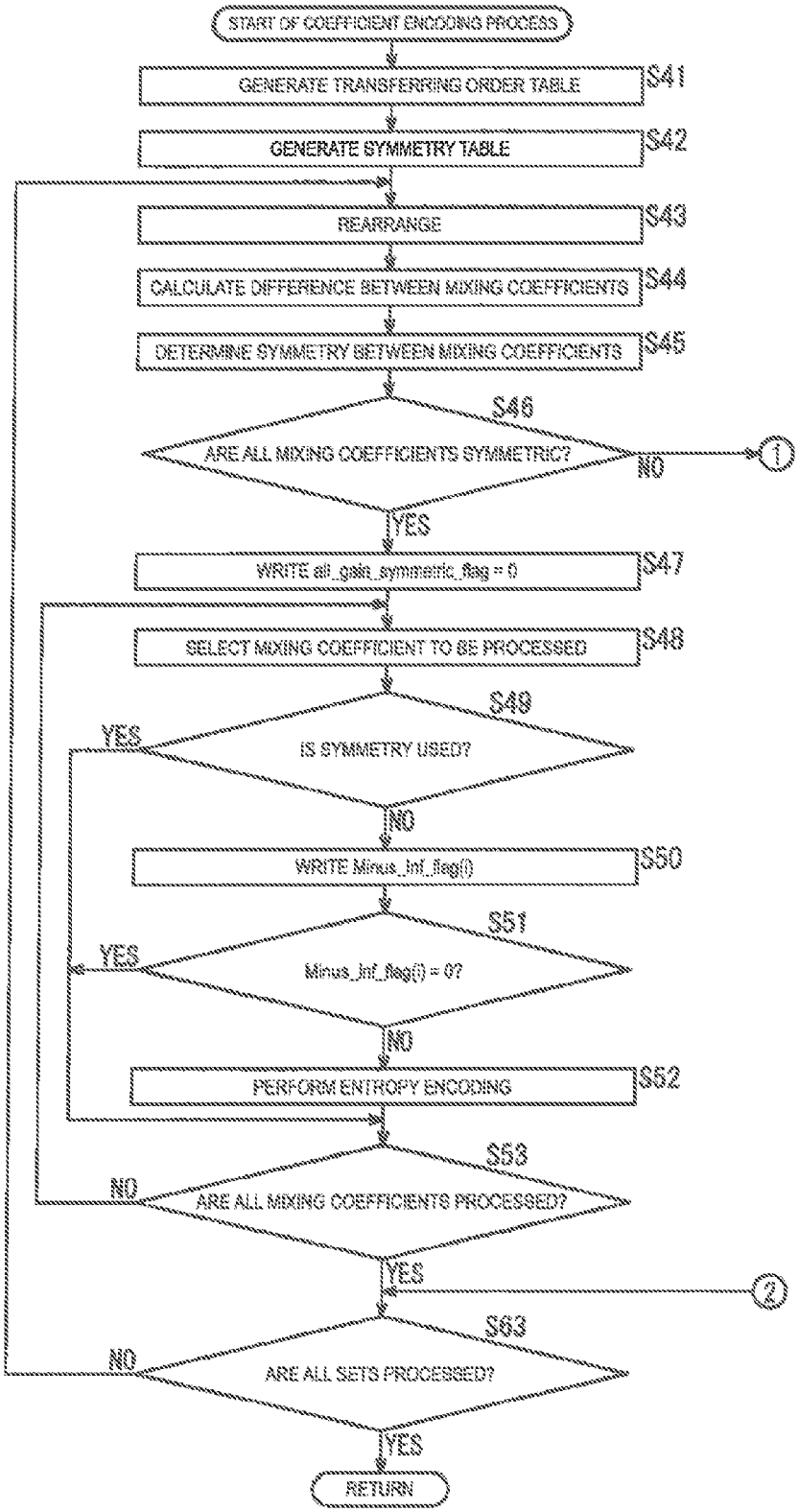
FIG. 14 is a flowchart showing a coefficient encoding process.
Figure 15:
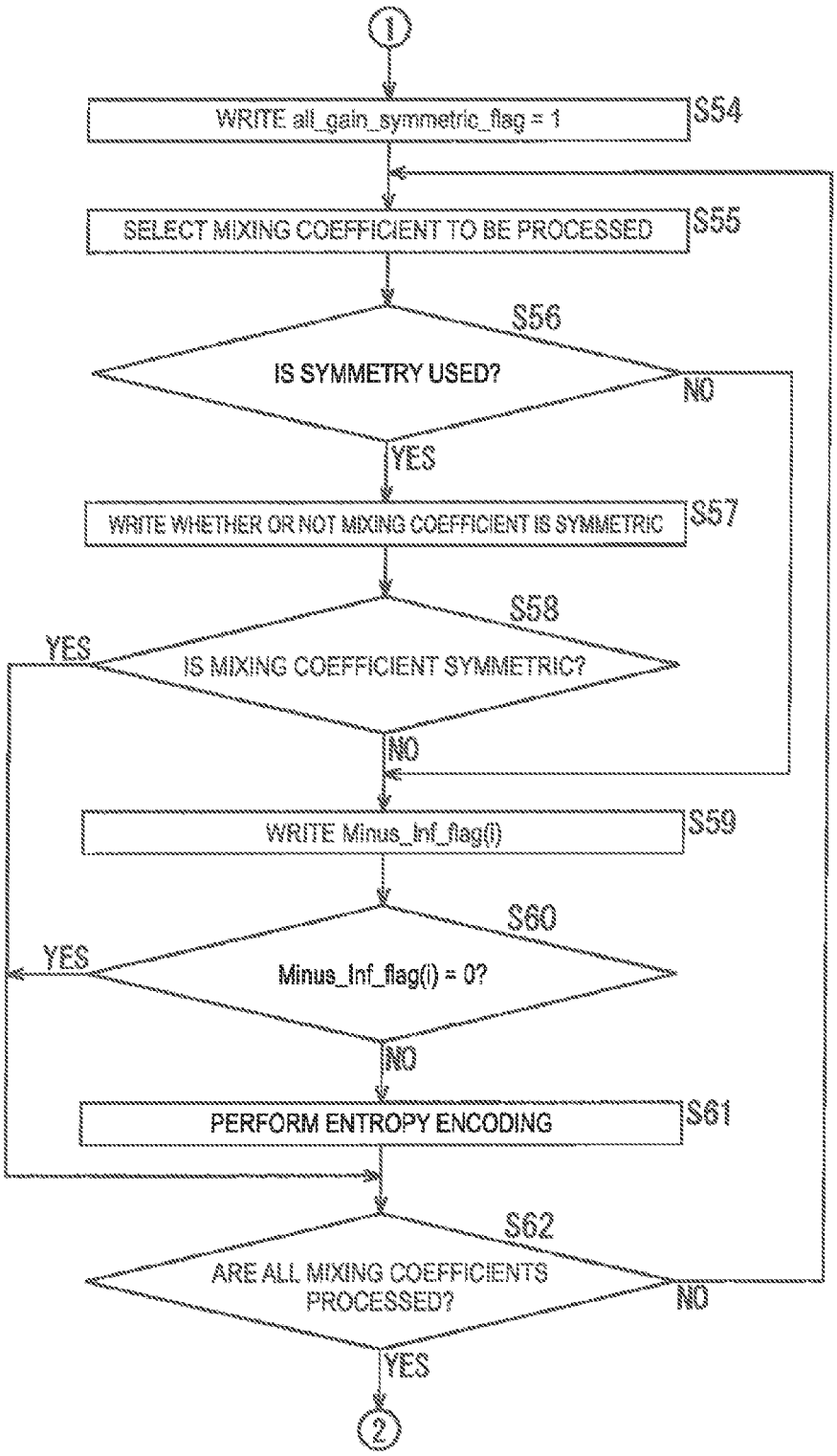
FIG. 15 is a flowchart showing a coefficient encoding process.

Note feat the processes of Step S122 and Step S123 are similar to the processes of Step S41 and Step S42 in FIG. 14, and description thereof is omitted. However, in Step S122, the order table generation unit 121 supplies the generated transferring order table to the symmetry table generation unit 122, the coefficient calculation unit 124, and the rearrangement unit 125. Further, in Step S123, the symmetry table generation unit 122 supplies the generated symmetry table to the decoding unit 123 and the coefficient calculation unit 124.

In Step S124, the decoding unit 123 determines whether or not all the mixing coefficients are symmetric on the basis of the flag all_gain_symmetric_flag written in the coefficient code string supplied from the demultiplexing unit 91. For example, in the case of the flag all_gain_symmetric_flag=0, it is determined that all the mixing coefficients are symmetric.

In the case where it is determined that all the mixing coefficients are symmetric in Step S124, in Step S125, the decoding unit 123 selects a single mixing coefficient MixGain(i) to be processed. For example, unprocessed mixing coefficients are selected one by one in the ascending transferring order from the mixing coefficient MixGain(1) to the mixing coefficient having the last transferring order.

In Step S126, the decoding unit 123 determines whether or not symmetry has been used for encoding the mixing coefficient MixGain(i) to be processed on the basis of the symmetry table. For example, in the case where the symmetry value syn(i) of the mixing coefficient to be processed is 0, it is determined that symmetry has not been used. In the case where the symmetry value syn(i) of the mixing coefficient to be processed is a value other than 0, it is determined that symmetry has bees used.

In the case where it is determined that symmetry has been used in Step S126, the decoding unit 123 supplies a symmetric flag indicating that the value of the mixing coefficient MixGain(i) to be processed is symmetric to the coefficient calculation unit 124, and the processing proceeds to Step S129.

On the contrary, in the case where it is determined that symmetry has not been used in Step S126, in Step S127, the decoding unit 123 determines whether or not the value of the flag Minus_Inf_flag(1) of the mixing coefficient MixGain(i) to be processed, which is written in the coefficient code string, is 0.

In the case where it is determined that the value of the flag Minus_Inf_flag(i) is 0 in Step S127, the decoding unit 123 supplies $-\infty$ to the coefficient calculation unit 124 as a value of the mixing coefficient MixGain(i) to be processed, and the processing proceeds to Step S129. At this times the decoding unit 123 also supplies a symmetric flag indicating that the value of the mixing coefficient MixGain(i) to be processed is asymmetric to the coefficient calculation unit 124.

Meanwhile, in the ease where it is determined that the value of the flag Minus_Inf_flag(i) is 1 in Step S127, the decoding unit 123 decodes the mixing coefficients in Step S128.

That is, the decoding unit 123 reads the differential value MixGain(i)_diff(i) of the mixing coefficient MixGain(i) to be processed, which is written in the coefficient code string, and decodes the differential value.

For example, in the example of FIG. 10, the MixGain_diff [idmx][i] is read and decoded. Note that, in the ease where the mixing coefficient to be processed is a mixing coefficient positioned at the top of each class, a cord word obtained by encoding the value of the mixing coefficient itself written as the MixGain_diff[idmx][i] is read and decoded.

The decoding unit 123 supplies, to the coefficient calculation unit 124, the differential value of the mixing coefficient or the mixing coefficient obtained by the decoding and the symmetric flag indicating that the value of the mixing coefficient to be processed is asymmetric.

In the ease where the mixing coefficient is decoded in Step S128, it is determined that symmetry has been used in Step S126, or the flag Minus_Inf_flag(i)=0 is determined in Step S127, a process of Step S129 is performed.

That is, in Step S129, the decoding unit 123 determines whether or not all the mixing coefficients have been processed. That is, it is determined whether or not all the mixing coefficients have been decoded as mixing coefficients to be processed.

In the case where it is determined that not all the mixing coefficients have been processed in Step S129, the processing returns to Step S125 and the above processing is repeated. On the contrary, in the ease where it is determined that all the mixing coefficients have been processed in Step S129, the processing proceeds to Step S136.

In the case where it is determined that sot all the mixing coefficients are symmetric in Step S124, in Step S130, die decoding unit 123 selects a single mixing coefficient MixGain(i) to be processed.

In Step S131, the decoding milt 123 determines whether or not symmetry has been used for encoding the mixing coefficient MixGain(i) to be processed.

For example, in the case where the flag Symmetry_info_flag(i) of the mixing coefficient to be processed is written in the coefficient code string, it is determined that symmetry has been used.

In the case where it is determined that symmetry has not been used in Step S131, fee processing proceeds to Step S133.

On the contrary, in the case where it is determined that symmetry has been used in Step S131, in Step S132, the decoding unit 123 determines whether or not the value of the mixing coefficient MixGain(i) to be processed is symmetric. For example, in the case where the value of the flag Symmetry_info_flag(1) of the mixing coefficient MixGain (i) to be processed, which is written in the coefficient code string, is 0, it is determined that the value of the mixing coefficient is symmetric.

In the case where it is determined that the value of fee mixing coefficient is symmetric in Step S132, the decoding unit 123 supplies a symmetric flag indicating that the value of the mixing coefficient MixGain(i) to be processed is symmetric to the coefficient calculation unit 124, and the processing proceeds to Step S135.

Meanwhile, in the case where it is determined that the value of the mixing coefficient is not symmetric in Step S132, the processing proceeds to Step S133.

In the case where it is determined that the value of the mixing coefficient is not symmetric in Step S132 or it is determined that symmetry has not been used in Step S131, a process of Step S133 is performed.

That is, in Step S133, the decoding unit 123 determines whether or not the value of the flag Minus_Inf_flag(i) of the mixing coefficient MixGain(i) to be processed, which is written in the coefficient code string, is 0.

In the case where it is determined that the value of the flag Minus_Inf_flag(i) is 0 in Step S133, the decoding unit 123 supplies $-\infty$ as the value of the mixing coefficient MixGain (i) to be processed to the coefficient calculation unit 124, and the processing proceeds to Step S135. At this time, the decoding unit 123 also supplies the symmetric flag indicating that the value of the mixing coefficient MixGain(i) to be processed is asymmetric to the coefficient calculation unit 124.

Meanwhile, in the ease where it is determined that the value of the flag Minus_Inf_flag(i) is 1 in Step S133, the decoding unit 123 decodes the mixing coefficient in Step S134.

That is, the decoding unit 123 reads the differential value MixGain(i)_diff(i) of the mixing coefficient MixGain(i) to be processed, which is written in the coefficient code string, and decodes the differential value MixGain(i)_diff(i). Note that, in the ease where the mixing coefficient to be processed is a mixing coefficient positioned at the top of each class, a cord word obtained by encoding the value of the mixing coefficient itself is read and decoded.

The decoding trait 123 supplies, to the coefficient calculation unit 124, the differential value of the mixing coefficient or the mixing coefficient obtained by decoding and the symmetric flag indicating that, the value of the mixing coefficient to be processed is asymmetric.

In the ease where the mixing coefficient is decoded in Step S134, it is determined that the value of the mixing coefficient is symmetric in Step S132, or the flag Minus_Inf_flag(i)=0 is determined in Step S133, a process of Step S135 is performed.

That is, in Step S135, the decoding unit 123 determines whether or not all the mixing coefficients have been processed.

In the case where it is determined that not all fee mixing coefficients have been processed in Step S135, the processing returns to Step S130 and the above processing is repeated. On the contrary, in the case where it is determined that all the mixing coefficients have been processed in Step S135, the processing proceeds to Step S136.

In the ease where it is determined that all the mixing coefficients have been processed in Step S129 or Step S135, a process of Step S136 is performed. That is, the coefficient calculation unit 124 selects a single mixing coefficient MixGain(i) to be processed in Step S136. For example, unprocessed mixing coefficients are selected one by one in the ascending transferring order from the mixing coefficient MixGain(1) to the mixing coefficient having fee last transferring order.

In Step S137, the coefficient calculation unit 124 determines whether or not symmetry has actually been used at the time of encoding the mixing coefficient to be processed, i.e., whether or not the value of the mixing coefficient is symmetric on the basis of the symmetric flag supplied from the decoding unit 123.

In the case where it is determined that symmetry has not been used in Step S137, in Step S138, the coefficient calculation unit 124 determines whether or not the mixing coefficient to be processed which is supplied from the decoding unit 123 is a differential value of the mixing coefficient.

Specifically, the coefficient calculation unit 124 determines whether or not the value supplied from the decoding unit 123 is a differential value on the basis of the transferring order table supplied from the order table generation unit 121 and the differential value of the mixing coefficient or the mixing coefficient supplied from the decoding unit 123.

For example, in the ease where the mixing coefficient to be processed is a mixing coefficient positioned at the top of a class in the transferring order table, i.e., a mixing coefficient having the first transferring order among the mixing coefficients belonging to the same class, it is determined that the value supplied from the decoding unit 123 is not a differential value but is a value of the mixing coefficient itself.

Further, for example, in the case where all values of the mixing coefficients belonging to the same class as the mixing coefficient to be processed and having earlier transferring order than that of the mixing coefficient to be processed are $-\infty$, it is determined that the value supplied from the decoding unit 123 is not a differential value but is a value of the mixing coefficient itself. Note that whether or not the value of the mixing coefficient is $-\infty$ can be specified by determining whether or not the value of the mixing coefficient supplied from the decoding unit 123 is $-\infty$.

Also in the case where the value of the mixing coefficient to be processed which is supplied from the decoding unit 123 is $-\infty$, it is determined that the value supplied from the decoding unit 123 is not a differential value.

In Step S138, is the case where it is determined that the value is not a differential value, the coefficient calculation unit 124 determines that the value supplied from the decoding unit 123 is a value of the mixing coefficient itself to be processed, and the processing proceeds to Step S141.

On the contrary, in the case where it is determined that the value is a differential value in Step S138, in Step S139, the coefficient calculation unit 124 performs an adding process on the basis of the differential value of the mixing coefficient to be processed which is supplied from the decoding unit 123 and the transferring order table.

That is, the coefficient calculation unit 124 calculates the mixing coefficient MixGain(i) to be processed by adding the differential value of the mixing coefficient to be processed which is supplied from the decoding unit 123 to a value of a mixing coefficient feat has been used for calculating the above differential value of the mixing coefficient. After the mixing coefficient to be processed is calculated, the processing proceeds to Step S141.

In the case where it is determined that symmetry has been used in Step S137, in Step S140, the coefficient calculation unit 124 copies the mixing coefficient on the basis of the symmetry table supplied from the symmetry table generation unit 122 and sets the copied mixing coefficient as the mixing coefficient MixGain(i) to be processed.

That is, a value of a mixing coefficient having a symmetric positional relationship with the mixing coefficient itself to be processed is set as a value of the mixing coefficient to be processed. After the mixing coefficient to be processed is obtained, the processing proceeds to Step S141.

In the case where the mixing coefficient is copied in Step S140, the adding process is performed in Step S139, or it is determined that the value is not a differential value in Step S138, a process of Step S141 is performed.

That is, in Step S141, the coefficient calculation unit 124 determines whether or not all the mixing coefficients have been processed.

In the case where it is determined that not all the mixing coefficients have been processed in Step S141, the processing returns to Step S136 and the above processing is repeated. On the contrary in the case where it is determined that all the mixing coefficients have been processed in Step S141, the coefficient calculation unit 124 supplies the mixing coefficients having the transferring order to the rearrangement unit 125, and the processing proceeds to Step S142.

In Step S142, the rearrangement unit 125 rearranges the mixing coefficients supplied from the coefficient calculation unit 124 in order suitable for a reproduction environment of the decoding device 81 with the use of the transferring order table supplied from the order table generation unit 121 and supplies the rearranged mixing coefficients to fee mixing process unit 94. After the mixing coefficients are rearranged, the coefficient decoding process is terminated, and then the processing proceeds to Step S94 in FIG. 18.

In this way, the decoding device 81 decodes the mixing coefficients encoded by using the distances between the sound source positions and the speaker positions and the symmetry between the mixing coefficients. When the mixing coefficients that have been efficiently encoded as described above are decoded, it is possible to obtain higher quality audio with a less code amount.

Note that, although an example where encoding is performed by calculating differential values between mixing coefficients has been described above, encoding may be performed by using symmetry between the mixing coefficients themselves without calculating the differential values. Alternatively, all the differential values of the mixing coefficients may be written in the coefficient code string without using symmetry.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose personal computer or the like that is capable of executing various functions when various programs are installed.

Figure 21:
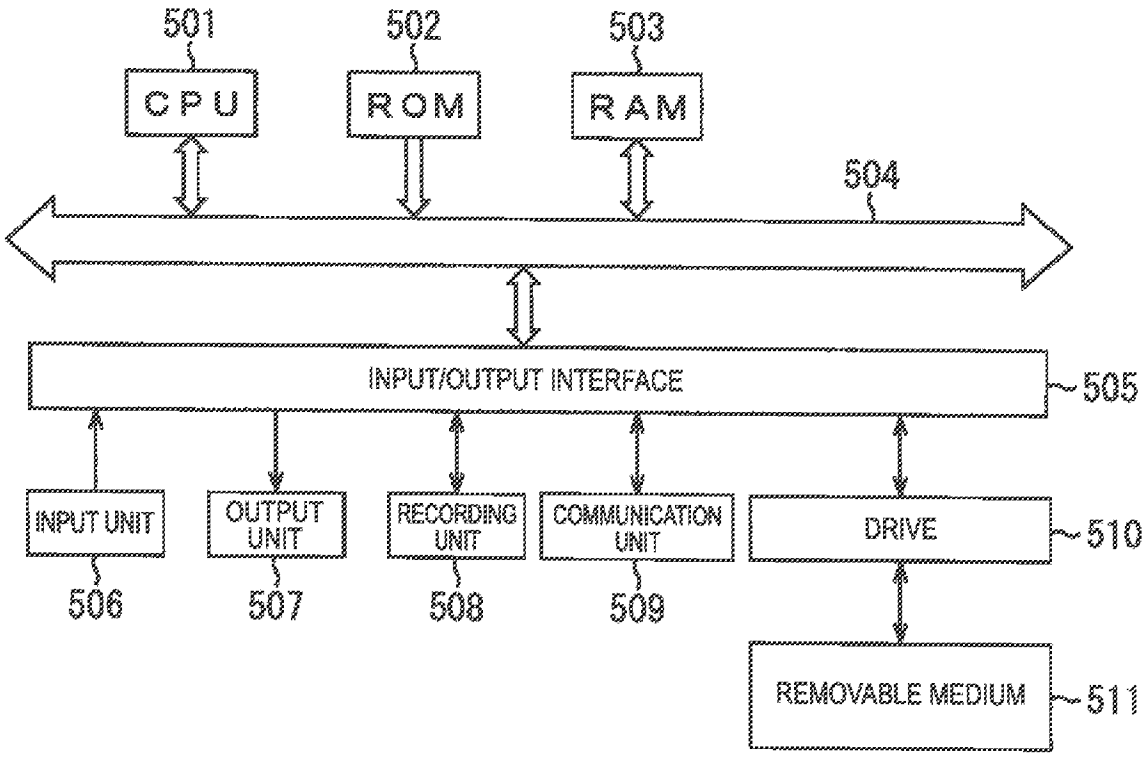
FIG. 21 is a configuration example of a computer.

FIG. 21 is a block diagram showing a hardware configuration example of a computer that performs the above-described series of processing using a program.

In such computer, a CPU (Central Processing Unit) 501, a ROM (Read Only Memory) 502, and a RAM (Random Access Memory) 503 are connected to one another by a bus 504.

As input/output interface 505 is also connected to the bus 504. An input unit 506, an output unit 507, a recording unit 50S, a communication unit 509, and drive 510 are connected to the input/output interface 505.

The Input unit 506 is configured from a keyboard, a mouse, a microphone, an imaging device or the like. The output unit 507 is configured from a display, a speaker or the like. The recording unit 508 is configured from a hard disk, a non-volatile memory or the like. The communication unit 509 is configured from a network Interface or the like. The drive 510 drives a removable medium 511 such as a magnetic disk, as optical disk, a magneto-optical disk, a semiconductor memory or the like.

In the computer configured as described above, as one example the CPU 501 loads a program recorded in the recording unit 508 via the input/output interface 505 and the bus 504 into the RAM 503 and executes the program to carry out the series of processes described earlier.

Programs to be executed by the computer (the CPU 501) are provided being recorded in the removable medium 511 which is a packaged medium or the like. Also, programs may be provided via a wired or wireless transmission medium, such as a local area network, the Internet or digital satellite broadcasting.

Is the computer, by loading the removable recording medium 511 into the drive 510, the program can be installed into the recording unit 508 via the input/output interface 505, it is also possible to receive the program from a wired or wireless transfer medium using the communication unit 509 and install the program into the recording unit 508. As another alternative, the program can be installed in advance into the ROM 502 or the recording unit 508.

It should be noted that the program executed by a computer may be a program that is processed in time series according to the sequence described in this specification or a program that is processed In parallel or at necessary timing such as upon calling.

An embodiment of the present technology is not limited to the embodiments described above, and various changes and modifications may be made without departing from the scope of the present technology.

For example, the present technology can adopt a configuration of cloud computing which processes by allocating and connecting one function by a plurality of apparatuses through a network.

Further, each step described by the above mentioned flow charts can be executed by one apparatus or by allocating a plurality of apparatuses.

In addition, in the case where a plurality of processes is included in one step, the plurality of processes included in this one step can be executed by one apparatus or by allocating a plurality of apparatuses.

The advantageous effects described herein are not limited, but merely examples. Any other advantageous effects may also be attained.

Additionally, the present technology may also be configured as below.

(1)

An encoding device, including:

an order table generation unit configured to generate an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

a rearrangement unit configured to rearrange the plurality of mixing coefficients in the order shown in the order table;

a difference calculation unit configured to calculate a differential value between two consecutive mixing coefficients among the mixing coefficients rearranged in the order; and an encoding unit configured to encode the differential value calculated for each of the mixing coefficients.

(2)

The encoding device according to (1), further including:

a symmetry table generation unit configured to generate a symmetry table showing symmetry of a positional relationship between the mixing coefficients; and a symmetry determination unit configured to determine, on the basis of the symmetry table, that, in the case where the mixing coefficient and another mixing coefficient having the positional relationship symmetric to the mixing coefficient have the same value, the mixing coefficient and the other mixing coefficient are symmetric.

wherein the encoding unit does not encode the differential value of the mixing coefficient determined to be symmetric to the other mixing coefficient.

(3)

The encoding device according to (2), wherein the symmetry determination unit further determines whether or not each of all the mixing coefficients having the positional relationship symmetric to the other mixing coefficient is symmetric to the corresponding another mixing coefficient having the symmetric positional relationships, and wherein the encoding unit encodes the differential value on the basis of a result of determination on whether or not all the mixing coefficients are symmetric to the other mixing coefficient.

(4)

The encoding device according to any one of (1) to (3), wherein the encoding unit performs entropy encoding with respect to the differential value, (5)

The encoding device according to any one of (2) to (4), wherein, in the case where the input speaker for the mixing coefficient and the input speaker for the other mixing coefficient are positioned to have left-right symmetry and the output speaker for the mixing coefficient and the output speaker for the other mixing coefficient are positioned to have left-right symmetry, the positional relationship between the mixing coefficient and She other mixing coefficient is symmetric.

(6)

The encoding device according to any one of (1) to (5), wherein the difference calculation unit calculates the differential value between the mixing coefficient and a mixing coefficient having a value that is not $-\infty$ and having the order closest to the order of the mixing coefficient.

(7)

The encoding device according to any one of (1) to (6), wherein the order table generation unit generates the order table by classifying the mixing coefficients into a plurality of classes so that, in the case where the number of the input speakers is larger than the number of the output speakers, the mixing coefficients of the same output speakers belong to the same class while classifying the mixing coefficients into a plurality of classes so that, in the case where the number of the output speakers is larger than the number of the input speakers, the mixing coefficients of the same input speakers belong to the same class and determining arrangement order of the mixing coefficients in each of the classes, and wherein the difference calculation unit calculates the differential value between the mixing coefficients belonging to the same class.

(8)

An encoding method, including the steps of;

generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

rearranging the plurality of mixing coefficients in the order shown in the order table;

calculating a differential value between two consecutive mixing coefficients among die mixing coefficients rearranged in the order; and encoding the differential value calculated for each of the mixing coefficients.

(9)

A program causing a computer to execute a process including the steps of:

generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

rearranging the plurality of mixing coefficients in the order shown in the order table;

calculating a differential value between two consecutive mixing coefficients among the mixing coefficients rearranged in the order; and encoding the differential value calculated for each of the mixing coefficients.

(10)

A decoding device, including:

an order table generation unit configured to generate an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

a decoding unit configured to acquire a code string obtained by calculating a differential value between two consecutive mixing coefficients arranged in the order shown in the order table and encoding the differential value calculated for each of the mixing coefficients and decode the code string;

an addition unit configured to add the differential value obtained by the decoding to one of the mixing coefficients used for calculating the differential value on the basis of the order table to calculate the other one of the mixing coefficients used for calculating the differential value; and a rearrangement unit configured to rearrange the mixing coefficients on the basis of the order table and output the mixing coefficients.

(11)

The decoding device according to (10), wherein, in the case where the mixing coefficient and another mixing coefficient having a positional relationship symmetric to the mixing coefficient, have the same value, the mixing coefficient and the other mixing coefficient are symmetric, and the differential value of the mixing coefficient is not encoded, wherein the decoding device further includes a symmetry table generation unit configured to generate a symmetry table showing the positional relationship between the mixing coefficients, and wherein, in the case where the mixing coefficient and the other mixing coefficient are symmetric, the addition unit copies the other mixing coefficient on the basis of the symmetry table and sets the other mixing coefficient as the mixing coefficient.

(12)

The decoding device according to (10) or (11), wherein wherein the differential value is encoded on the basis of a result of determination on whether or not each of ail the mixing coefficients having the positional relationship symmetric to the other mixing coefficient is symmetric to the corresponding another mixing coefficient having the symmetric positional relationship, and wherein the decoding unit decodes the differential value on the basis of information indicating a result of determination on whether or not all the mixing coefficients are symmetric to the other mixing coefficient, the information being contained in the code string.

(13)

The decoding device according to (11) or (12), wherein, in the case where the input speaker for the mixing coefficient and the input speaker for the other mixing coefficient are positioned to have left-right symmetry and the output speaker for the mixing coefficient and the output speaker for the other mixing coefficient are positioned to have left-right symmetry, the positional relationship between the mixing coefficient and the other mixing coefficient is symmetric.

(14)

A decoding method, including the steps of;

generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

acquiring a code string obtained by calculating a differential value between two consecutive mixing coefficients arranged in the order shown in the order table and encoding the differential value calculated for each of the mixing coefficients and decoding the code string;

adding the differential value obtained by the decoding to one of the mixing coefficients used for calculating the differential value on the basis of the order table to calculate the other one of the mixing coefficients used for calculating the differential value; and rearranging the mixing coefficients on the basis of the order table and outputting the mixing coefficients.

(15)

A program causing a computer to execute a process including the steps of:

generating an order table showing arrangement order of mixing coefficients determined on the basis of distances between a plurality of input speakers and a plurality of output speakers, the mixing coefficients being mixing coefficients of the plurality of input speakers prepared for the plurality of respective output speakers and being used in a mixing process for converting audio signals of a plurality of channels corresponding to arrangement of the plurality of input speakers into audio signals of a plurality of channels corresponding to arrangement of the plurality of output speakers;

acquiring a code string obtained by calculating a differential value between two consecutive mixing coefficients arranged in the order shown in the order table and encoding the differential value calculated for each of the mixing coefficients and decoding the code string;

adding the differential value obtained by the decoding to one of the mixing coefficients used for calculating the differential value on tire basis of the order table to calculate the other one of the mixing coefficients used for calculating the differential value; and rearranging the mixing coefficients on the basis of the order table and outputting the mixing coefficients.

REFERENCE SIGNS LIST

11 encoding device
21 coefficient encoding unit
22 signal encoding on it
23 multiplexing unit
51 order table generation unit
52 symmetry table generation unit
53 rearrangement unit
54 difference calculation unit
55 symmetry determination unit
56 encoding unit
81 decoding device
91 demultiplexing unit
92 signal decoding unit
93 coefficient decoding unit 93
94 mixing processing unit
121 order table generation unit
122 symmetry table generation unit
123 decoding unit
124 coefficient calculation unit
125 rearrangement, unit

The invention claimed is:

1. An encoding device, comprising;

a central processing unit (CPU) configured to:

generate an order table that indicates an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process to convert audio signals of a plurality of first channels corresponding to a first arrangement of the plurality of input speakers into the audio signals of a plurality of second channels corresponding to a second arrangement of the plurality of output speakers;

rearrange the mixing coefficients in the arrangement order indicated in the order table;

calculate a differential value between two consecutive mixing coefficients among the mixing coefficients rearranged in the arrangement order; and encode the differential value calculated for each of the mixing coefficients.

2. The encoding device according to claim 1, wherein the CPU is further configured to:

generate a symmetry table that indicates a symmetry of a positional relationship between the mixing coefficients;

determine, based on the symmetry table, that a first mixing coefficient and a second mixing coefficient are symmetric, based on the first mixing coefficient and the second mixing coefficient that have a same value, wherein the second mixing coefficient has the positional relationship symmetric to the first mixing coefficient; and prevent the encoding of the differential value of the first mixing coefficient which is symmetric to the second mixing coefficient.

3. The encoding device according to claim 2, wherein the CPU is further configured to:

determine that each of the mixing coefficients, that has the positional relationship symmetric to the second mixing coefficient, is symmetric to a corresponding third mixing coefficient that has the symmetric positional relationship, and encode the differential value based on a result of the determination that the mixing coefficients are symmetric to the third mixing coefficient.

4. The encoding device according to claim 1, wherein the CPU is further configured to entropy encode with respect to the differential value.

5. The encoding device according to claim 2, wherein, based on a first input speaker for the first mixing coefficient and a second input speaker for the second mixing coefficient that are positioned to have left-right symmetry, and a first output speaker for the first mixing coefficient and a second output speaker for the second mixing coefficient that are positioned to have the left-right symmetry, the positional relationship between the first mixing coefficient and the second mixing coefficient is symmetric.

6. The encoding device according to claim 1, wherein the CPU is further configured to calculate the differential value between a first mixing coefficient and a second mixing coefficient, wherein the second mixing coefficient has a value other than $-\infty$ and has the arrangement order closest to the arrangement order of the first mixing coefficient.

7. The encoding device according to claim 1, wherein the CPU is further configured to:

generate the order table by classification of the mixing coefficients into a plurality of classes so that, based on a number of the plurality of input speakers that is larger than the number of the plurality of output speakers, the mixing coefficients of same output speakers belong to a same first class, and by classification of the mixing coefficients into the plurality of classes so that, based on the number of the plurality of output speakers that is larger than the number of the plurality of input speakers, the mixing coefficients of same input speakers belong to a same second class;

determine the arrangement order of the mixing coefficients in each of the plurality of classes; and calculate the differential value between the mixing coefficients that belong to the same first class or the same second class.

8. An encoding method, comprising:

in an encoding device:

generating, by a central processing unit (CPU) of the encoding device, an order table indicating an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process for converting audio signals of a plurality of first channels corresponding to a first arrangement of the plurality of input speakers into the audio signals of a plurality of second channels corresponding to a second arrangement of the plurality of output speakers;

rearranging, by the CPU of the encoding device, the mixing coefficients in the arrangement order indicated in the order table;

calculating, by the CPU of the encoding device, a differential value between two consecutive mixing coefficients among the mixing coefficients rearranged in the arrangement order; and encoding, by the CPU of the encoding device, the differential value calculated for each of the mixing coefficients.

9. A non-transitory computer-readable storage medium having stored thereon, computer-executable instructions that when executed by an encoding device, cause the encoding device to execute operations, the operations comprising:

generating, by a central processing unit (CPU) of the encoding device, an order table indicating an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process for converting audio signals of a plurality of first channels corresponding to a first arrangement of the plurality of input speakers into the audio signals of a plurality of second channels corresponding to a second arrangement of the plurality of output speakers;

rearranging, by the CPU of the encoding device, the mixing coefficients in the arrangement order indicated in the order table;

calculating, by the CPU of the encoding device, a differential value between two consecutive mixing coefficients among the mixing coefficients rearranged in the arrangement order; and encoding, by the CPU of the encoding device, the differential value calculated for each of the mixing coefficients.

10. A decoding device, comprising:

a central processing unit (CPU) configured to:

generate an order table that indicates an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process to convert audio signals of a plurality of first channels corresponding to a first arrangement of the plurality of input speakers into the audio signals of a plurality of second channels corresponding to a second arrangement of the plurality of output speakers;

acquire a code string obtained by calculation of a differential value between two consecutive mixing coefficients arranged in the arrangement order indicated in the order table and encoding of the differential value calculated for each of the mixing coefficients;

decode the code string;

add the differential value obtained by the decoding to a first mixing coefficient of the two consecutive mixing coefficients used for calculation of the differential value based on the order table to calculate a second mixing coefficient of the two consecutive mixing coefficients used for calculation of the differential value;

rearrange the mixing coefficients based on the order table; and output the mixing coefficients.

11. The decoding device according to claim 10, wherein, based on a determination that a third mixing coefficient and a fourth mixing coefficient, that has a positional relationship symmetric to the third mixing coefficient, have a same value, the third mixing coefficient and the fourth mixing coefficient are determined symmetric, wherein the encoding of the differential value of the third mixing coefficient is prevented, wherein the CPU is further configured to:

generate a symmetry table that indicates the positional relationship between the mixing coefficients, and based on the third mixing coefficient and the fourth mixing coefficient that are symmetric, the CPU is further configured to copy the fourth mixing coefficient based on the symmetry table and set the fourth mixing coefficient as the third mixing coefficient.

12. The decoding device according to claim 11, wherein wherein the differential value is encoded based on a result of determination that each of the mixing coefficients, that has the positional relationship symmetric to the fourth mixing coefficient, is symmetric to a corresponding fifth mixing coefficient that has the symmetric positional relationship, wherein the CPU is further configured to decode the differential value based on information that indicates the result of the determination that the mixing coefficients are symmetric to the fifth mixing coefficient, and wherein the information is contained in the code string.

13. The decoding device according to claim 11, wherein, based on a first input speaker for the third mixing coefficient and a second input speaker for the fourth mixing coefficient that are positioned to have left-right symmetry and a first output speaker for the third mixing coefficient and a second output speaker for the fourth mixing coefficient that are positioned to have the left-right symmetry, the positional relationship between the third mixing coefficient and the fourth mixing coefficient is symmetric.

14. A decoding method, comprising:

in a decoding device:

generating, by a central processing unit (CPU) of the decoding device, an order table indicating an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process for converting audio signals of a plurality of first channels corresponding to a first arrangement of the plurality of input speakers into the audio signals of a plurality of second channels corresponding to a second arrangement of the plurality of output speakers;

acquiring, by the CPU of the decoding device, a code string obtained by calculating a differential value between two consecutive mixing coefficients arranged in the arrangement order indicated in the order table and encoding the differential value calculated for each of the mixing coefficients;

decoding, by the CPU of the decoding device, the code string;

adding, by the CPU of the decoding device, the differential value obtained by the decoding to a first mixing coefficient of the two consecutive mixing coefficients used for calculating the differential value based on the order table to calculate a second mixing coefficient of the two consecutive mixing coefficients used for calculating the differential value;

rearranging, by the CPU of the decoding device, the mixing coefficients based on the order table; and outputting, by the CPU of the decoding device, the mixing coefficients.

15. A non-transitory computer-readable storage medium having stored thereon, computer-executable instructions that when executed by a decoding device, cause the decoding device to execute operations, the operations comprising:

generating, by a central processing unit (CPU) of the decoding device, an order table indicating an arrangement order of mixing coefficients determined based on distances between a plurality of input speakers and a plurality of output speakers, wherein the mixing coefficients are prepared for the plurality of output speakers based on the mixing coefficients of the plurality of input speakers, and wherein the mixing coefficients are used in a mixing process for converting audio signals of a plurality of first channels corresponding to a first arrangement of the plurality of input speakers into the audio signals of a plurality of second channels corresponding to a second arrangement of the plurality of output speakers;

acquiring, by the CPU of the decoding device, a code string obtained by calculating a differential value between two consecutive mixing coefficients arranged in the arrangement order indicated in the order table and encoding the differential value calculated for each of the mixing coefficients;

decoding, by the CPU of the decoding device, the code string;

adding, by the CPU of the decoding device, the differential value obtained by the decoding to a first mixing coefficient of the two consecutive mixing coefficients used for calculating the differential value based on the order table to calculate a second mixing coefficient of the two consecutive mixing coefficients used for calculating the differential value;

rearranging, by the CPU of the decoding device, the mixing coefficients based on the order table; and outputting, by the CPU of the decoding device, the mixing coefficients.

* * * * *